US009771245B2

(12) United States Patent
Kang

(10) Patent No.: US 9,771,245 B2
(45) Date of Patent: Sep. 26, 2017

(54) TIRED GANTRY CRANE AND STRADDLE CARRIER FOR RECEIVING POWER IN CONTACTLESS FASHION

(71) Applicant: Miyeon Kang, Seoul (KR)

(72) Inventor: Young Suk Kang, Busan (KR)

(73) Assignee: Miyeon Kang, Seoul (KR)

( * ) Notice: Subject to any disclaimer, the term of this patent is extended or adjusted under 35 U.S.C. 154(b) by 15 days.

(21) Appl. No.: 14/764,567

(22) PCT Filed: Jan. 28, 2014

(86) PCT No.: PCT/KR2014/000803

§ 371 (c)(1),
(2) Date: Jul. 29, 2015

(87) PCT Pub. No.: WO2014/119906

PCT Pub. Date: Aug. 7, 2014

(65) Prior Publication Data

US 2015/0360918 A1 Dec. 17, 2015

(30) Foreign Application Priority Data

Jan. 29, 2013 (KR) ..... 10-2013-0009760
Jan. 29, 2013 (KR) ..... 10-2013-0009762

(51) Int. Cl.

| | |
|---|---|
| ***B66C 13/12*** | (2006.01) |
| ***B66C 19/00*** | (2006.01) |
| ***B66C 13/04*** | (2006.01) |
| ***B66C 13/22*** | (2006.01) |

(52) U.S. Cl.

CPC ..... *B66C 13/12* (2013.01); *B66C 13/04* (2013.01); *B66C 13/22* (2013.01); *B66C 19/007* (2013.01)

(58) Field of Classification Search

CPC ..... B66C 13/12; B66C 13/04; B66C 13/22; B66C 19/007

See application file for complete search history.

(56) References Cited

FOREIGN PATENT DOCUMENTS

| | | | |
|---|---|---|---|
| EP | 2354075 | A1 | 8/2011 |
| JP | 2012-171760 | A | 9/2012 |
| KR | 10-2002-0073747 | A | 9/2002 |
| KR | 10-1058644 | B1 | 8/2011 |
| WO | 02-34663 | A1 | 5/2002 |

OTHER PUBLICATIONS

International Search Report for PCT/KR2014/000803.
Written Opinion of the International Search Authority for PCT/KR2014/000803.

*Primary Examiner* — Calvin Cheung
(74) *Attorney, Agent, or Firm* — The PL Law Group, PLLC

(57) ABSTRACT

Disclosed is a tired gantry crane and a straddle carrier for receiving power in a contactless fashion, and the tired gantry crane includes a rechargeable battery provided to supply power from the inside thereof, and a power collecting unit configured to receive power from a power supply unit installed at the outside, wherein the power supply unit and the power collecting unit interact with each other by means of magnetic induction. The straddle carrier includes a power collecting unit configured to receive power in a contactless fashion from a power supply unit installed at the outside, the power collecting unit charges a rechargeable battery installed at the straddle carrier, and the power supply unit and the power collecting unit interact with each other by means of magnetic induction.

18 Claims, 23 Drawing Sheets

TIRED GANTRY CRANE AND STRADDLE CARRIER FOR RECEIVING POWER IN CONTACTLESS FASHION

TECHNICAL FIELD

The present disclosure relates to a tired gantry crane and a straddle carrier for receiving power in a contactless fashion, and more particularly, to a rubber tired gantry crane (RTGC) for operating a ground power with a power supplied in a contactless fashion instead of a diesel power generator to substitute for an existing gantry crane which generates electricity by using a diesel fuel and operates a motor with the generated electricity for the works at a container yard, and a straddle carrier having a power collecting device for receiving power from a power supply unit installed at a container base in a contactless fashion.

The present application claims the benefit of Korean Patent Application No. 10-2013-0009760 and No. 10-2013-0009762 filed on Jan. 29, 2013 with the Korean Intellectual Property Office, the disclosure of which is incorporated herein by reference in its entirety.

BACKGROUND ART

A container terminal provided at a land of a harbor for loading or unloading of a container is a base for marine transportation by ships and land transportation by trucks, trains or the like, and berth facilities for ships (container ships), container loading and unloading facilities, container storage facilities and so on are organically constructed therein to facilitate smooth container distribution. Also, the container terminal is organically connected to a land transportation network including loads and railways.

In order to distribute containers without congestion at a harbor, a system for efficiently managing the entire container terminal is required, and also it is important to procure sufficient relevant facilities such as berth facilities for ships (container ships), container landing and carrying facilities, container storage facilities and so on.

In relation to landing/lifting of containers, a gantry crane installed at a container terminal or the like is a crane for a harbor, which has a door or bridge shape, and is used for stacking containers carried by trailers or loading the stacked containers on trailers.

As such a gantry crane, there is proposed a rail mounted gantry crane which moves on rails installed at a container terminal or the like, depending on its running method. The rail mounted gantry crane has an advantage in that a power on the land is directly connected and used through a cable reel or the like, but also has a disadvantage in that it has a bad degree of mobility freedom since it runs only on rails.

To overcome the above drawback, a tired gantry crane for generating power by operating a diesel engine in the crane itself and using the generated power has been recently proposed. The tired gantry crane may freely move to various places on roads, instead of rails, and thus ensures a high degree of mobility freedom in comparison to the rail mounted gantry crane.

Due to expensive oil price and environment pollution, a power source on the land is used as a main power by transmitting power through a cable reel or a booth bar, like the rail mounted gantry crane. The power is supplied from a power source installed at a container terminal in advance through a cable reel.

However, the method for supplying power required for driving a tired gantry crane by using a cable reel as described above is just allowed at a region where a cable reel is connected, and thus this greatly limits the degree of mobility freedom of the tired gantry crane.

In addition, in addition to tired gantry crane using a cable reel, there is also known a tired gantry crane using a hybrid method, which is driven using an electric battery (electric energy) and an internal combustion engine (fossil energy) in order not to damage the degree of mobility freedom. However, the hybrid method demands a great early-stage investment in comparison to a gantry crane using a cable reel, which uses only electric energy, and also there still remains a serious problem in environments since it uses a diesel fuel.

FIG. 1*a* is a diagram schematically showing an appearance of a container terminal installed at a tired gantry crane. In the container terminal as shown in FIG. 1*a*, if a cargo ship 1000 having a container cargo reaches a harbor, containers are primarily landed by a container crane 2000 installed at the harbor, and the landed containers are moved by a gantry crane 3000 to be stacked and stored at each workspace A to D or loaded on and carried by yard chassis (not shown) or yard tractors (not shown). On the contrary, containers carried by yard chassis or yard tractors may also be shipped on the cargo ship 1000).

In the container terminal, the tired gantry crane 3000 generally works at a predetermined workspace A to D and moves along a predetermined path. The inventors of the present disclosure have designed the invention from the understanding that the working performance of the tired gantry crane 3000 can be improved even though a battery-rechargeable power source is used instead of a cable reel, as long as the tired gantry crane 3000 can obtain necessary energy at each workspace.

Generally, a gantry crane needs to move to a certain location in order to unload a container carried by a trailer or loading a stored container on a trailer. For this, the gantry crane has a travelling mechanism. The tired gantry crane moves through a manual manipulation of a driver along a moving lane marked on the ground (movement in lanes) and unloads a container.

In order to apply unmanned operation thereto, a line mark is generally used in the existing technique as a gantry crane running method. In this running method, a line mark is marked along a running path of a crane, and a camera for photographing the line mark in real time is installed. In addition, a location of the line mark is continuously found by using image information acquired through the camera, and a motor is controlled using a program logic controller so that the crane is located within a predetermined range from the center of the line mark, thereby guiding stable straight running of the crane.

However, this existing crane running method has problems as follows.

First, the crane may collide. In the existing technique, since the camera is fixedly focused on the line mark while the crane is running, a crane running direction, namely, a front view, should be monitored substantially depending on the sight of a driver. For this reason, if a driver does not detect an obstacle present in the crane running direction, the crane may collide with the obstacle, and this accident may cause material damages and, on occasions, damage of human life.

Second, works are seriously limited by external environmental (weather) conditions. In the existing technique, when it rains, particularly when it is snowy, the line mark may not be easily recognized, and thus it is very difficult to drive the crane by detecting the line mark through a camera. For example, if snow is piled up on the ground, it is substantially impossible to detect the line mark through a camera, and also when ice is formed on the line mark, it is substantially impossible to acquire image information through the camera. For this reason, in these cases, it is impossible to drive a crane, and a snow-removing work is required for driving the crane, which may delay the work.

Third, efficiency and productivity for optimized landing are deteriorated. In the existing technique, a transport vehicle such as a trailer for carrying a container should be stopped just due to the experience of a driver of the transport vehicle, and thus the transport vehicle should be adjusted by forward or backward movement when unloading the container, which deteriorates work efficiency and productivity of the crane.

Meanwhile, in a vertically-arranged harbor structure frequently used in Europe or the like, in relation to landing/lifting of a container, the container has a short transport distance, and thus three works for loading a container on a yard tractor by a crane and storing a newly carried container by the yard tractor crane may be operated just by a straddle carrier, which lifts a container and moves by itself.

A gantry crane installed at a container terminal or the like is a crane for a harbor, which has a door or bridge shape, and is used for stacking a container carried by a straddle carrier and placed on the ground or moving a stacked container to a location where the container may be loaded on a straddle carrier.

FIG. 1*b* is a diagram schematically showing a vertically-arranged container terminal. In the container terminal as shown in FIG. 1*b*, if a cargo ship having a container reaches a harbor, containers are primarily unloaded and placed on the ground by a container crane installed at the harbor, and a straddle carrier picks the container placed on the ground, moves the container to an open storage yard and places the container on the open storage yard. Then, the yard crane picks the container placed on the ground again and stacks on the open storage yard.

On the contrary, a container carried by a straddle carrier is shipped on a cargo ship in a reverse order to the above.

The straddle carrier is equipment capable of picking a container and moving a short distance in a container terminal, and its greatest advantage is to reduce a standby time of an existing vertically-arranged harbor, during which a crane should wait until a yard trailer comes or until a yard trailer loads a container.

As shown in FIG. 1*b*, the straddle carrier just moves from a rear location of a crane of FIG. 1*b*, which unloads a container, to an entrance of a container loading region due to its special use in the container yard. From the fact that a straddle carrier moves only within a predetermined loading area or along a predetermined path, the inventors of the present disclosure have designed the invention from the understanding that if energy for operating a vehicle can be obtained in each workspace, all problems of a straddle carrier of hybrid method which uses a mixture of fossil fuel and electric fuel and a straddle carrier of a battery method which operates with a large-capacity battery can be solved together.

In addition, for an unmanned operation of a straddle carrier, in an existing technique, a guideline is generally formed using a paint or the like along a path along which the straddle carrier should move so that the straddle carrier may run by recognizing the guideline with a camera, or a transponder or the like is generally buried in the ground so that the straddle carrier may run by recognizing a location of the sensor. However, if a guideline is formed on the road, the guideline may not be recognized in a snowy day, which disturbs the unmanned operation. In addition, if the guideline is erased as time goes, the guideline should be repaired, which requires maintenance costs. From this, the inventors have designed an unmanned operation using a laser scanner such as a global positioning system (GPS).

SUMMARY

The present disclosure is designed to solve the problems of the related art, and therefore the present disclosure is directed to providing a tired gantry crane, which requires low maintenance costs in comparison to an existing hybrid-type gantry crane by using no diesel fuel without damaging the degree of mobility freedom of the tired gantry crane, requires low installation costs by needing no large-capacity battery, and also allows unmanned automation by automatically adjusting a location of the crane.

In addition, the present disclosure is directed to providing a straddle carrier, which requires low maintenance costs in comparison to an existing hybrid-type straddle carrier, contributes to the reduction of $CO_2$ by using no fossil fuel, and requires low installation costs in comparison to an electric straddle by needing no large-capacity battery.

In addition, the present disclosure is directed to providing an unmanned straddle carrier, which is not affected by weather or surrounding environments when an existing unmanned running method of a straddle carrier using a guideline is performed.

In one aspect of the present disclosure, there is provided a tired gantry crane for receiving power in a contactless fashion, which includes a rechargeable battery provided to supply power from the inside thereof; and a power collecting unit configured to receive power from a power supply unit installed at the outside, wherein the power supply unit and the power collecting unit interact with each other by means of magnetic induction.

The power collecting unit may include a pick-up unit, and the pick-up unit includes a power collecting core and a power collecting coil. Here, one end of the pick-up unit may be connected to a frame of the tired gantry crane via an arm, and when power is supplied by means of magnetic induction with the power supply unit, the arm may be spread to be parallel to the power supply unit formed on a road surface, and then when the tired gantry crane moves, the arm may be folded to be perpendicular to the power supply unit.

In addition, the tired gantry crane may further comprise a power controller for managing supply of power, and the power controller may control supply of power through the rechargeable battery formed therein and the power supply unit depending on an operation state of the tired gantry crane.

When the tired gantry crane is moving, the power controller may control to supply power from the rechargeable battery to a motor, which operates as a load.

In addition, the tired gantry crane may further comprise a unit for detecting a moving direction and a tension of a rope to which a container is suspended, and the power controller may control to supply power from the power supply unit to a load based on the moving direction and the tension of the rope.

In addition, when the moving direction of the rope is a lifting direction, the power controller may supply power from both the rechargeable battery and the power supply unit to a motor which operates as a load, and when the moving direction of the rope is a landing direction, the power controller may supply power from the rechargeable battery to the motor which operates as a load, and the power from the power supply unit is used for charging the rechargeable battery.

The power supply unit may be buried or exposed to be parallel to a road surface, and the power supply unit may be formed to be movable on the road surface.

In an embodiment of the present disclosure, the tired gantry crane may further includes first laser scanners respectively installed at front and rear portions of a left wheel of the tired gantry crane one by one to sense an obstacle present in a running direction of the tired gantry crane, a transport vehicle present in a transport vehicle area and a container loaded on the transport vehicle by means of vertical rotation and provide corresponding first sensing information; second laser scanners respectively installed at front and rear portions of a right wheel of the tired crane one by one to sense a container stored in a container yard and a floating structure installed in the running direction of the tired gantry crane by means of vertical rotation and provide corresponding second sensing information; and a main controller for receiving the first and second sensing information, controlling a collision of the tired gantry crane based on the first or second sensing information, and rotating the first laser scanner to control the first laser scanner to sense the transport vehicle when a container is not loaded on the transport vehicle present in the transport vehicle area based on the first sensing information.

Preferably, the first and second laser scanner may be a two-dimensional laser scanner or a three-dimensional laser scanner.

Preferably, the first laser scanners may sense a fixing device for fixing a container loaded on the transport vehicle to the transport vehicle and provide information about whether the container loaded on the transport vehicle is separated from the transport vehicle when the container is unloaded from the transport vehicle.

Preferably, if a container is not loaded on the transport vehicle present in the transport vehicle area based on the first sensing information, the main controller may control the first laser scanner to rotate downwards so that the first laser scanner senses the transport vehicle.

Preferably, the main controller may analyze a location of the transport vehicle present in the transport vehicle area or the container loaded on the transport vehicle based on the first sensing information, compare the location of the transport vehicle or the location of the container loaded on the transport vehicle with a current location of the tired gantry crane, and provide a guide indication for location adjustment to a driver of the transport vehicle according to the comparison result.

Preferably, the main controller may analyze a location of an obstacle present in a running direction of the tired gantry crane based on the first sensing information, compare the location of the obstacle with a current location of the tired gantry crane, and control the location of the tired gantry crane not to collide with the obstacle.

Preferably, if a container is not present in the container yard based on the second sensing information, the main controller may control the second laser scanner to sense the floating structure by rotating the second laser scanner downwards.

Preferably, the main controller may analyze a location of the container stored in the container yard or a location of the floating structure based on the second sensing information, compare the location of the container stored in the container yard or the location of the floating structure with a current location of the tired gantry crane, and control a location of the tired gantry crane.

Preferably, the main controller may analyze a location of an obstacle present in a running direction of the tired gantry crane based on the second sensing information, compare the location of the obstacle with a current location of the tired gantry crane, and control the tired gantry crane not to collide with the obstacle.

Preferably, the floating structure may be a booth bar or a cable reel hole.

Preferably, the main controller may recognize a location of the floating structure and controls the tired gantry crane based on the recognized distance.

In another aspect of the present disclosure, there is also provided a straddle carrier for receiving power in a contactless fashion, which includes a power collecting unit configured to receive power in a contactless fashion from a power supply unit installed at the outside, wherein the power collecting unit charges a rechargeable battery installed at the straddle carrier, and wherein the power supply unit and the power collecting unit interact with each other by means of magnetic induction.

At this time, the power collecting unit may include a pick-up unit, and the pick-up unit includes a power collecting core and a power collecting coil. Here, one end of the pick-up unit may be connected to a bottom frame of the straddle carrier via an elevation unit, and when power is supplied by means of magnetic induction between the power supply unit and power collecting unit, the pick-up unit may be disposed adjacently to be parallel to the power supply unit formed on a road surface by means of the elevation unit.

The power collecting unit may receive power from the power supply unit and charge the rechargeable battery with the power when the straddle carrier is moving along a power line or stop, and the rechargeable battery may supply power to a load when the straddle carrier moves beyond the power line.

According to the present disclosure, it is possible to provide a tired gantry crane, which does not damage the degree of mobility freedom by adopting a contactless power transmission method using electromagnetic induction, requires low maintenance costs in comparison to an existing hybrid-type gantry crane by using no diesel fuel, and requires low early-stage installation costs by using a relatively smaller-capacity battery.

In addition, the tired gantry crane according to the present disclosure is configured to move by using an internal battery and also to operate for works requiring a relatively great load by using supplementary power supplied from an external power supply device and use remaining power to charge the internal battery, thereby preventing power from being unnecessarily wasted.

Moreover, according to the present disclosure, laser scanners capable of rotating vertically based on a crane running direction are respectively installed at front and rear portion of right and left wheels of the crane, and a sensing region is adjusted by rotating the laser scanners vertically, which enables unmanned operation of the crane and also prevents collision of the crane and deviation from its running direction. In addition, the unmanned automation is realized by automated location adjustment of the crane, and efficiency and productivity for loading of the crane may be improved.

In addition, in the present disclosure, crane running is automated by controlling a location of the crane by using a container stored in a container yard or a floating structure, which may minimize influences given by external environments and thus greatly improve work efficiency in comparison to an existing technique.

Moreover, according to the present disclosure, since only four laser scanners are installed in total, namely two laser scanners to each of right and left wheels of the crane, it is possible to reduce installation costs and simplify the system.

Meanwhile, the present disclosure may provide a straddle carrier, which requires reduced maintenance costs in comparison to a hybrid-type straddle carrier, does not cause environmental pollution since fossil fuels are not used, and requires low early-stage installation costs by using a relatively smaller-capacity battery in comparison to an electric-charging straddle carrier using an expensive large-capacity battery.

| [Reference Symbol] | |
|---|---|
| 100: crane | 101: rope |
| 102: booth bar | 103: cable reel hole |
| 110: trolley | 120: guide rail |
| 130: spreader | 140: body unit |
| 141: upper frame | 142: support frame |
| 150a: first wheel | 150b: second wheel |
| 151a, 151b: tire wheel | 152a, 152b: fork |
| 153a, 153b: connection frame | 161a, 161b: first laser scanner |
| 162a, 162b: second laser scanner | 170: main controller |
| 171: sensing information analyzing unit | 172: first controller |
| 173: central processing unit | 174: crane location analyzing unit |
| 175: second controller | 180: power supply unit |
| 181: power line | 190: power collecting unit |
| 191: pick-up unit | 192: stabilizing unit |
| 200: trailer | 300: container |
| 400 straddle carrier | 410 power collecting unit |
| 411: stabilizing unit | 411a: regulator |
| 411b: internal charging battery | 411c: battery management system |
| 411d: DC-DC converter | 411e: power conversion unit |
| 411f: electronic device | 412: motor |
| 413: pick-up unit | 413a: power collecting coil |
| 413b: power collecting core | 420: power supply unit |
| 421: magnetic field generating unit | 422: power line or guideline |
| 430: elevation unit | 440: laser scanner |
| 450: induced magnetic field detection unit | 480: controller |
| 490: sensing information analyzing unit | 510a, 510b: container |

DETAILED DESCRIPTION

It should be understood that the terms used in the present disclosure are not intended to limit the present disclosure but used for explain specific embodiments, and a singular expression should be interpreted as including a plural meaning, unless stated otherwise. Several embodiments may be proposed in the present disclosure, and any features overlapped with each other may be not described in duplication.

Hereinafter, preferred embodiments of the present disclosure will be described in detail with reference to the accompanying drawings so that they can be easily implemented by those skilled in the art.

Figure 1A:
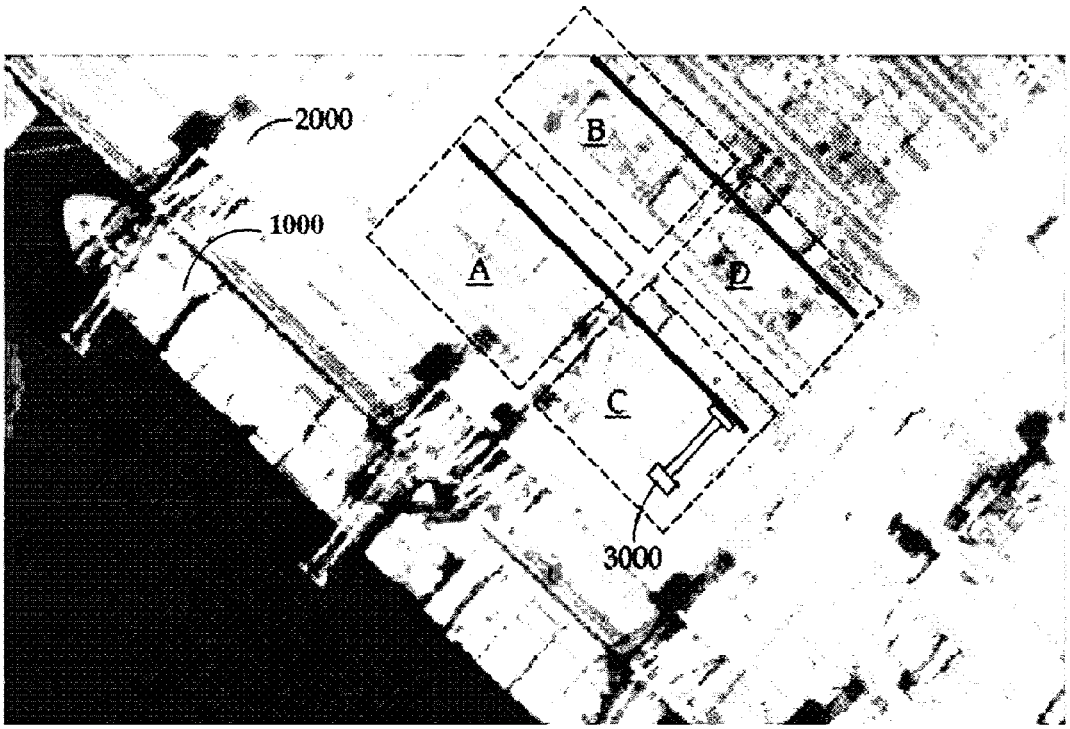
FIGS. 1*a* and 1*b* are diagrams schematically showing a container terminal system formed at a harbor.
Figure 1B:
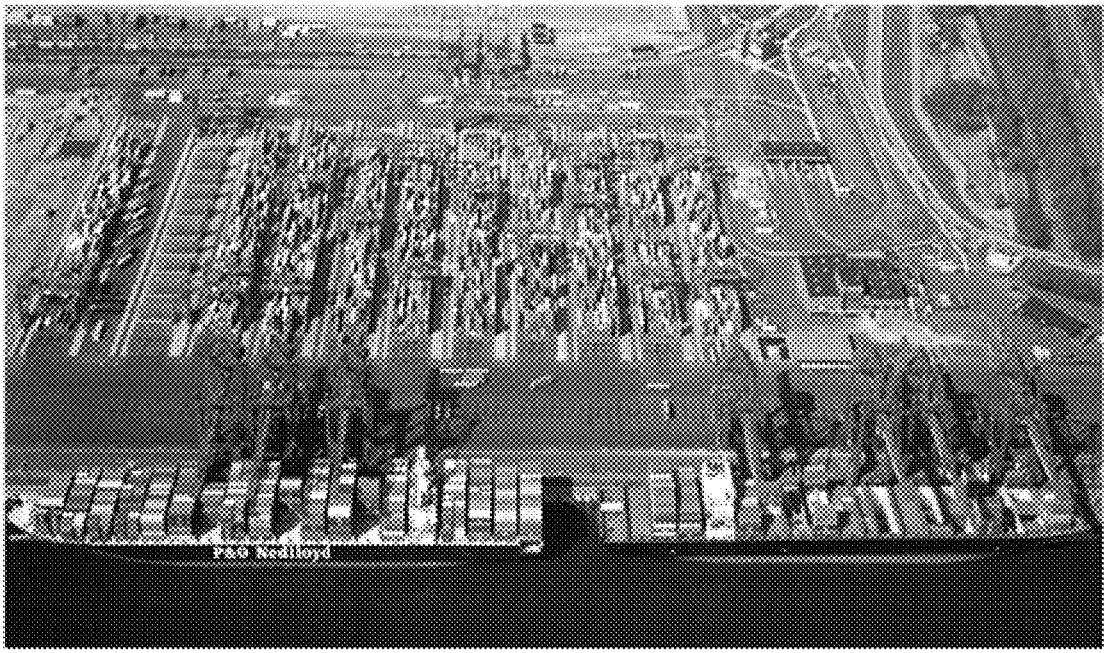
Figure 2:
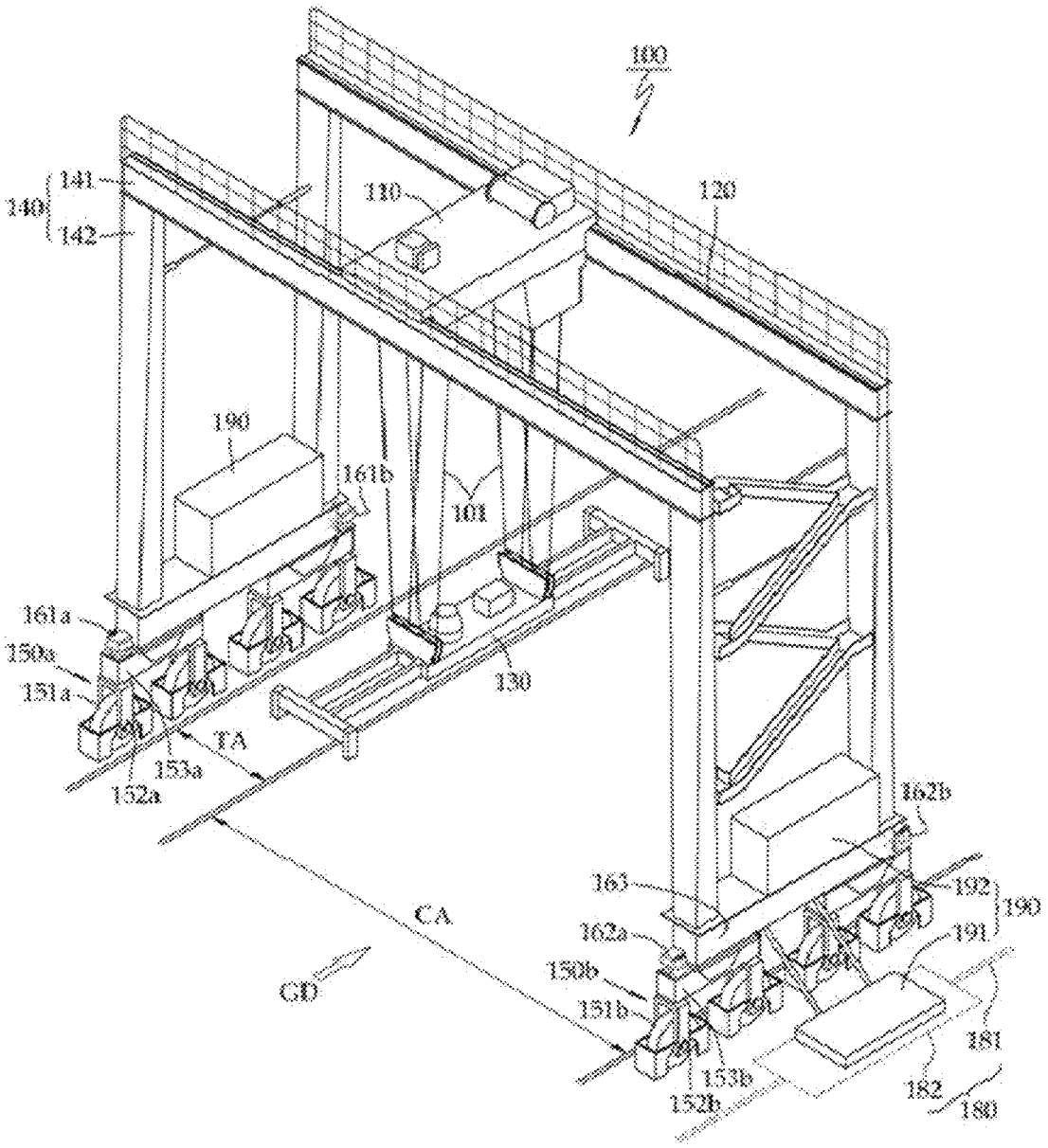
FIG. 2 is a diagram schematically showing a tired gantry crane according to an embodiment of the present disclosure.

FIG. 2 is a perspective view showing a tired gantry crane according to an embodiment of the present disclosure. Referring to FIG. 2, the tired gantry crane according to an embodiment of the present disclosure includes a crane 100. The present disclosure is not limited to the crane structure depicted in FIG. 2, and any tired gantry crane of various structures may be included in the present disclosure.

The crane 100 includes a trolley 110, a spreader 130, a body unit 140 and wheels 150*a*, 150*b*. Hereinafter, for convenience, the wheel 150*a* installed at a left side of the crane 100 will be called a first wheel, and the wheel 150*b* installed at a right side will be called a second wheel.

The trolley 110 is installed to move in a length direction (horizontal direction) of an upper frame 141 of the crane 100 along a guide rail 120 installed at the upper frame 141. A spreader 130 is connected to the trolley 110 toward the ground, namely in a vertical direction, by means of a rope 101.

The spreader 130 is connected to the trolley 110 through the rope 101 as described above and moves in a length direction of the upper frame 141 in association with the trolley 110. In addition, the spreader 130 moves vertically by means of upward or downward movement of the rope 101 connected to the trolley 110.

The body unit 140 forms a framework of the crane 100 and includes an upper frame 141 and a support frame 142. The guide rail 120 is installed at the upper frame 141. The upper frame 141 may be integrally installed with the support frame 142 installed vertically or may be integrated thereto by using a coupling member.

The first and second wheels 150*a*, 150*b* are running devices respectively installed at both sides, namely right and left sides, of the crane 100 to move the crane 100 in a running direction, and includes a plurality of tire wheels 151*a*, 151*b*, forks 152*a*, 152*b* for gripping the tire wheels 151*a*, 151*b*, and connection frames 153*a*, 153*b*. The connection frames 153*a*, 153*b* connect the forks 152*a*, 152*b* to the support frame 142 of the body unit 140 and may be formed to have a plate structure with a flat upper surface.

Laser scanners 161*a*, 161*b* (hereinafter, first laser scanners) and laser scanners 162*a*, 162*b* (hereinafter, referred to as second laser scanners) are respectively installed at the wheels 150*a*, 150*b* of the crane 100. The first and second laser scanners 161*a*, 161*b*, 162*a*, 162*b* may employ two-dimensional laser scanners (2D laser scanners) or three-dimensional laser scanners (3D laser scanners). For example, the first laser scanners 161*a*, 161*b* may employ three-dimensional laser scanners, and the second laser scanners 162*a*, 162*b* may employ two-dimensional laser scanners.

The first laser scanners 161*a*, 161*b* may be installed at the left wheel 150*a*, so that one scanner is installed to each of both sides (front and rear sides) thereof in a running direction. The first laser scanners 161*a*, 161*b* may be installed to rotate, or be rotatable, in a vertical direction (upwards or downwards) based on a running direction GD of the crane 100. For example, the first laser scanners 161*a*, 161*b* may rotate or be installed to rotate as much as 40 degrees based on the running direction GD.

Figure 8:
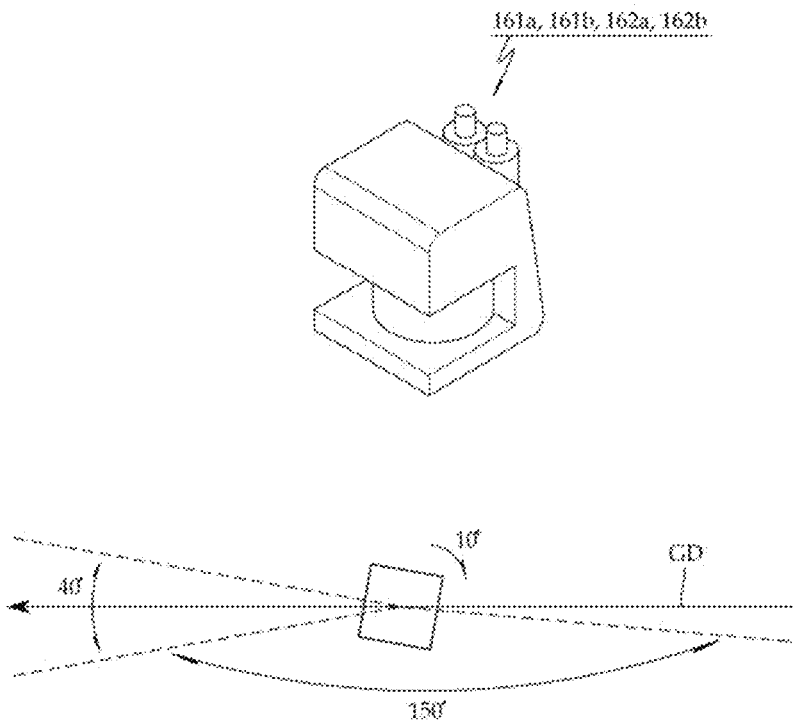
FIG. 8 is a diagram for illustrating a sensing area of first and second laser scanners depicted in FIG. 2.

As shown in FIG. 8, the first laser scanners 161*a*, 161*b* may be configured to sense an area as much as 180 degrees or above, preferably 210 degrees or above. Based on the sensing area, the first laser scanners 161*a*, 161*b* may sense an obstacle present in a running direction when the crane is running, and may also sense a transport vehicle such as a trailer present in a transport vehicle area TA where the transport vehicle passes, as well as a container loaded on the transport vehicle.

In addition, the first laser scanners 161*a*, 161*b* may sense a fixing device (not shown) for fixing a container loaded on a transport vehicle to the transport vehicle. The sensing information obtained as above is provided to a main controller 170, and the main controller 170 may determine whether the container loaded on the transport vehicle is separated from the transport vehicle, by analyzing the sensing information, when the container loaded on the transport vehicle is unloaded.

As shown in FIG. 2, the second laser scanners 162*a*, 162*b* are installed at the right wheel 150*b* of the crane 100, so that one scanner is installed at each of both sides (front and rear sides) thereof in a running direction. The second laser scanners 162*a*, 162*b* may be installed to rotate, or be rotatable, in a vertical direction (upwards or downwards) based on the running direction GD of the crane 100. For example, the second laser scanners 162*a*, 162*b* may rotate or be installed to rotate as much as 40 degrees based on the running direction GD.

As shown in FIG. 8, the second laser scanners 162*a*, 162*b* may sense an area as much as 180 degrees or above, preferably 210 degrees or above. Based on the sensing area, the second laser scanners 162*a*, 162*b* may sense an obstacle present in a running direction when the crane is running, and also as shown in FIG. 2, the second laser scanners 162*a*, 162*b* may sense containers stored in the container yard CA and a floating structure installed in a running direction of the crane 100. For example, the floating structure may be a booth bar 102 depicted in FIG. 13 or a cable reel hole 103 depicted in FIG. 14.

A wiring system for supplying power to the crane 100 may be prepared at the booth bar 102, and reset markings are provided at the booth bar 102 at regular intervals. The location of the crane 100 may be sensed by detecting the reset marking. In addition, a wiring system for supplying power to the crane 100 may be provided to the cable reel hole 103.

As shown in FIG. 2, the first laser scanners 161*a*, 161*b* may be installed at an upper surface of a connection frame 153*a* of the first wheel 150*a*. In addition, the second laser scanners 162*a*, 162*b* may be installed at an upper surface of the connection frame 153*b* of the second wheel 150*b*. However, in the present disclosure, installation locations of the first and second laser scanners 161*a*, 161*b*, 162*a*, 162*b* are not limited to the connection frames 153*a*, 153*b*, and the first and second laser scanners 161*a*, 161*b*, 162*a*, 162*b* may be installed at any location if a container and a transport vehicle can be sensed. For example, the first and second laser scanners 161*a*, 161*b*, 162*a*, 162*b* may be installed at the support frame 142.

The tired gantry crane according to the present disclosure employs a contactless power transmission method in order to solve problems of existing hybrid or cable-type tired gantry cranes, such as deteriorated mobility freedom, excessive battery capacity, great maintenance and installation costs or the like.

In the contactless power transmission method, power is supplied in a contactless fashion power by means of electromagnetic induction between a power collecting unit and a power supply unit disposed to face the power collecting unit. In the present disclosure, in order to use the contactless power transmission method, a power supply unit 180 installed in advance at a working place of the tired gantry crane and a power collecting unit 190 installed at the tired gantry crane are provided.

Figure 3:
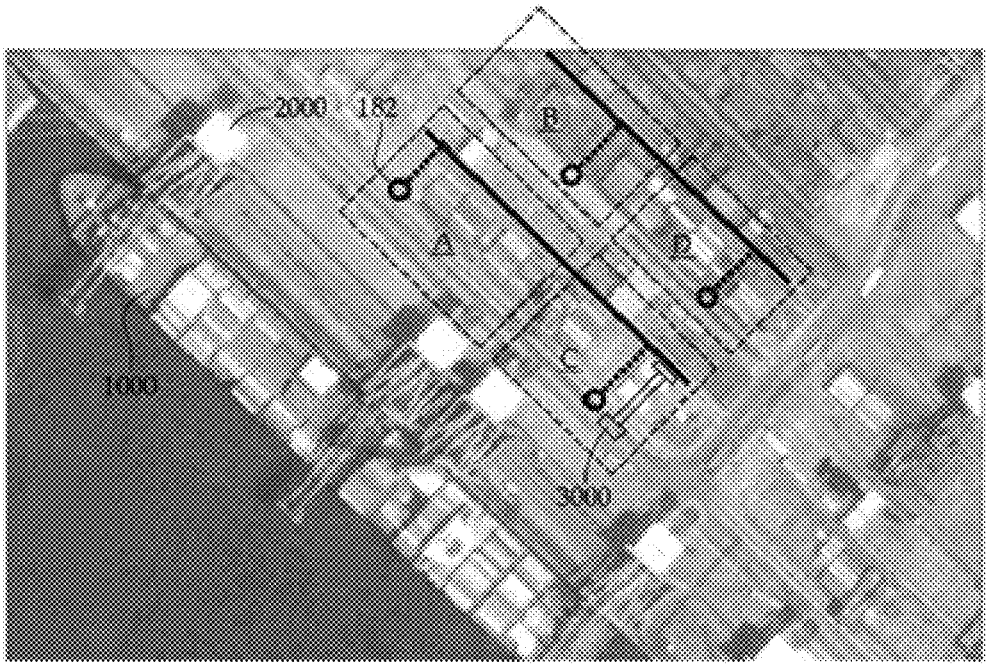
FIG. 3 is a diagram schematically showing a container terminal system formed at a harbor according to an embodiment of the present disclosure.

The power supply unit 180 is installed in advance in a workspace A to D as shown in FIG. 3, and as a general structure, the power supply unit 180 includes a power supply line (not shown), a power supply core (not shown) and a power supply coil (not shown). In addition, the power supply unit 180 is preferably formed to be buried in the workspace A to D or exposed therefrom so as not to disturb movement of a crane. The power supply unit using magnetic induction is already known in the art and thus is not described in detail here.

Next, as shown in FIG. 2, the tired gantry crane according to the present disclosure includes a power collecting unit 190, and the power collecting unit 190 includes a pick-up unit 191 and a power-collecting driving unit 192. Hereinafter, the configuration of the power collecting unit 190 will be described with reference to FIG. 4.

Figure 4:
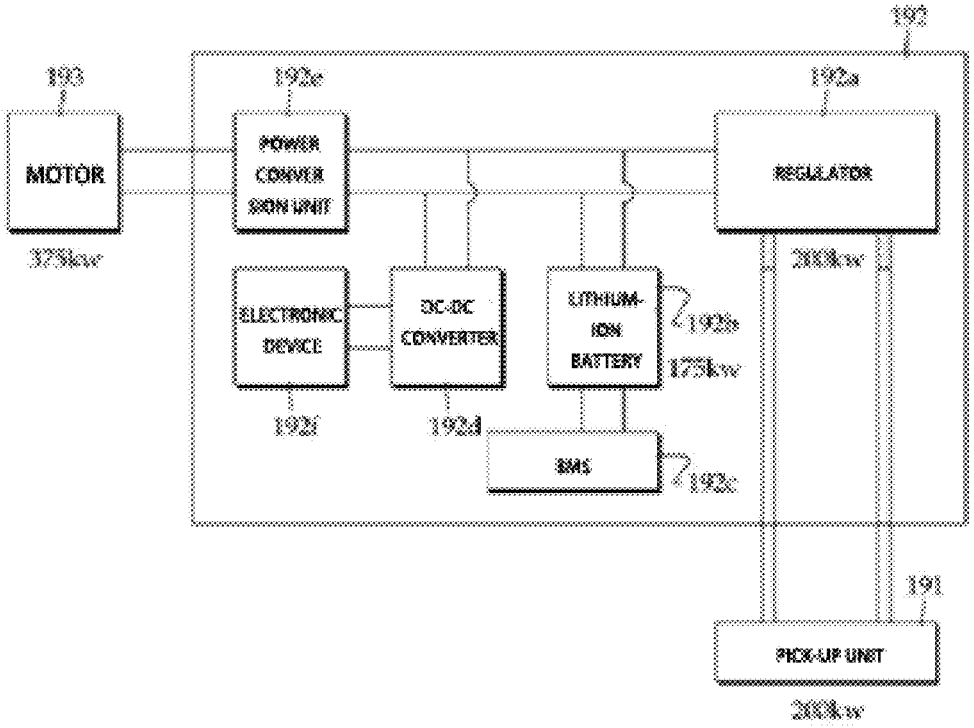
FIG. 4 is a diagram schematically showing a power collecting unit employed in the tired gantry crane according to an embodiment of the present disclosure.

FIG. 4 is a circuitry block diagram schematically showing the power collecting unit 190 installed at the tired gantry crane according to the present disclosure. As shown in FIG. 4, the power collecting unit 190 includes a pick-up unit 191 for responding to a magnetic change from the power supply unit 180 and a power-collecting driving unit 192 for stably supplying induced power obtained from the pick-up unit to a motor.

Figure 5:
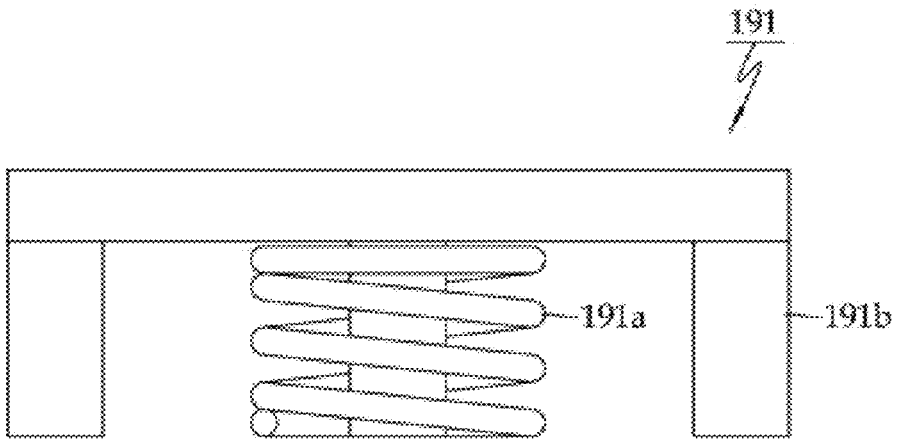
FIG. 5 is a diagram schematically showing a pick-up device of the power collecting unit according to an embodiment of the present disclosure.

FIG. 5 is a diagram showing the pick-up unit 191 of the power collecting unit 190, and the pick-up unit includes a power collecting coil 191*a* installed at a core 191*b*. The power collecting coil 191*a* is configured to allow an induced current formed by magnetic field induction to flow if power is supplied to the power supply unit 180.

In addition, as shown in FIG. 2, the pick-up unit 191 of the power collecting unit 190 is formed at side frame 163 of the tired gantry crane. At this time, the pick-up unit 191 may be connected by an arm unit so as to be spread to be parallel to the power supply unit 180 formed on a road surface when power is supplied wirelessly and also to be folded or lifted to be perpendicular to the power supply unit 180 when moving. When power is supplied through the pick-up unit 191 of the power collecting unit 190, if a distance between the pick-up unit 191 and the power supply unit 180 is small, the power supply efficiency is greatly increased.

Next, referring to FIG. 4 again, the induced power obtained from the pick-up unit 191 may not be provided to a common power device (a motor driving power source), and thus in the present disclosure, a power-collecting driving unit 192 or a stabilizing unit 192 for stabilizing the induced power obtained from the pick-up unit 191 is provided. The induced power obtained from the pick-up unit 191 is firstly converted into DC power through a regulator 192*a*, and the DC power is supplied to a load through a power conversion unit 192*e* for adjusting the DC power as an operating voltage of a motor 193 serving as a load.

At this time, if the motor is a three-phase alternate current motor, the power conversion unit 192*e* may employ an inverter for converting DC power to AC power again, and if the motor is an AC motor, a chopper or the like may be used for controlling DC power. In other words, the power conversion unit 192*e* may be modified depending on conditions of a load used. In this embodiment, the motor 193 adopts a three-phase alternate current motor, and an inverter is used as the power conversion unit 192*e*.

In addition, as shown in FIG. 4, the stabilizing unit 192 of the power collecting unit 190 installed at the tired gantry crane according to the present disclosure further includes a battery 192*b* between the power conversion unit 192*e* and the regulator 192*a*. The battery 192*b* is configured to be rechargeable and supplies necessary power to the motor 193 together with the regulator 192*a*. For example, in an embodiment of the present disclosure, the motor 193 requires power of 375 kW, and it is designed that the battery 192*b* supplies power of 175 kW and the regulator supplies power of 200 kW. Here, a needed amount of power of a lithium-ion battery may be selected according to a necessary power of the motor. For reference, a battery currently used for an electric vehicle or the like is designed to supply power of 800 kW or above, and such a large-capacity battery is very heavy and also very expensive.

Therefore, the charging capacity of a battery should be selected in consideration of efficiency and economic feasibility. In the present disclosure, when the tired gantry crane moves, which requires a small amount of power, the power is supplied from an internal battery. Also, when the crane performs an unloading process, the battery is charged with power supplied from the power supply unit. In addition, when the tire-type gantry crane performs a lifting motion, which requires a large amount of power, deficient power is supplied from the power supply unit (the regulator). For this reason, in the subject invention, a relatively smaller-capacity battery may be adopted.

In addition, the battery 192*b* installed at the tired gantry crane according to the present disclosure may include a battery management system (BMS) circuit for ensuring the battery not to drop its voltage below a certain level and also preventing the battery from being overcharged over a certain level, thereby stably keeping the battery 192*b*.

In addition, the stabilizing unit 192 of the power collecting unit 190 installed at the tired gantry crane according to the present disclosure may further include a DC-DC converter 192*d* between the battery and the power conversion unit 192*e* so that power may be stably supplied to an electronic device 192*f* required for the crane in addition to the motor 193, for example a power controller required for controlling the crane.

Figure 6:
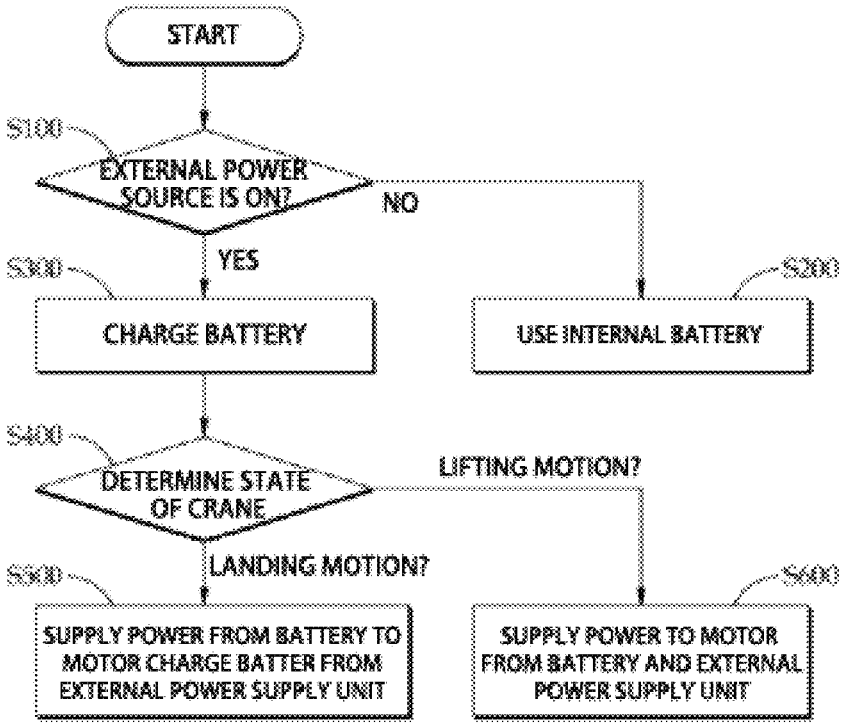
FIG. 6 is a schematic flowchart for illustrating a power supply operation of a power controller according to an embodiment of the present disclosure.

Next, referring to FIG. 6, a power supply method of the tired gantry crane according to the present disclosure will be described. FIG. 6 is a schematic flowchart for illustrating a power supply method of the tired gantry crane according to the present disclosure의 supply of power.

The present disclosure adopts a relatively smaller-capacity battery as described above, and thus it is required to efficiently supply and manage power. For this, in the present disclosure, a power controller for electronically controlling power supply of the crane is needed.

As shown in FIG. 6, the power controller firstly determines whether the power collecting unit 190 of the tired gantry crane according to the present disclosure receives power from the power supply unit 180 (Step S100). If not (corresponding to a case where the crane is moving), the power controller supplies necessary power from the internal battery (Step S200). If power is received from the external power supply unit 180, the power controller charges the internal battery with the power supplied from the external power supply unit (Step S300). When the internal battery is charged with the power supplied from the external power supply unit, the power controller determines a current state of the crane (Step S400), and combines the power from the internal battery and the power from the external power supply unit according to the current state.

When the tired gantry crane is moving, a great power is not consumed, and such power can be sufficiently covered by the internal battery which gives 175 kW. In addition, when the tired gantry crane lands (or, descends) a container, a great power is not required. However, when the tired gantry crane lifts (ascends) a container, a great power is required, and such a great power is not sufficiently covered by the internal battery which gives 175 kW, and it is needed to receive power from an external power source. In other words, when it is needed to conduct a work requiring power exceeding 175 kW provided by the internal battery, power should be supplied from the external power supply device.

Basically, the supply of power from the internal battery and the external power supply unit is controlled so that the tired gantry crane according to the present disclosure operates as follows. In detail, the tired gantry crane is moved just using the internal battery. Also, when the tired gantry crane stops at a workspace and lands or lifts a container, power is supplied from the internal battery and the external power supply device as follows.

First, since a great power is not consumed during a container landing motion, power required for the motor is covered by the internal battery, and simultaneously the power supplied from the external power supply device is used for charging the internal battery (Step S500).

Next, since a great power is demanded during a container lifting motion, the power required for the motor is covered by both the internal battery and the external power supply device (Step S600). The container lifting motion and the container landing motion may be determined by providing a sensor for detecting a moving direction of the motor or the rope.

TABLE 1

| External power source | Rope (motor) direction sensor | Supply of external power | Supply of internal power |
|---|---|---|---|
| Off | — | — | ○ |
| On | Lifting | ○ (supply to the motor) | ○ |
| On | Landing | ○ (charge the internal battery) | ○ |

In the present disclosure, in order to control the supply of power from the internal battery and the external power supply device more precisely, a unit for sensing a tension of the rope of the crane may be further provided in addition to a unit for sensing a moving direction of the rope of the crane.

The power controller may determine whether a current operation of the crane is a lifting motion or a landing motion, based on the moving direction of the rope of the crane, and may also determine whether an article such as a container is loaded on the crane, based on the tension of the rope of the crane. In addition, based on the above determination, the power controller may determine whether power is supplied to the motor only from the battery or from both the battery and the external power supply device.

For example, if the rope of the crane has a lifting direction (ascending) and a tension applied to the rope is greater than a reference value, the power controller may determine that the crane is currently lifting an article such as a container, and thus the power controller may control the supply of power so that power may be supplied from the internal battery and the external power supply device to the maximum. Similarly, if the rope of the crane has a lifting and a tension applied to the rope is smaller than the reference value, the power controller may determine that the crane is currently lifting the rope but no article or a very light article is suspended by the rope, based on the tension applied to the rope and then allow the lifting motion to be performed just with the internal battery.

Table 2 below schematically shows a combination of the supply of power by the internal battery and the external power supply device when a rope tension sensor is further provided.

TABLE 2

| External power source | Rope direction sensor | Rope tension sensor | Supply of external power | Supply of inner power |
|---|---|---|---|---|
| Off | — | — | — | ○ |
| On | Lifting | Above the reference value | ○ (supply to the motor) | ○ |
| On | Lifting | Below the reference value | ○ (charge the battery) | ○ |
| On | Landing | Above the reference value | ○ or x (supply to the motor or charge the battery) | ○ |

TABLE 2-continued

| External power source | Rope direction sensor | Rope tension sensor | Supply of external power | Supply of inner power |
|---|---|---|---|---|
| On | Landing | Below the reference value | ○ (charge the battery) | ○ |

In Table 2, it is designed that the power is supplied from the external power supply device only when a load torque at the motor is relatively great. Here, it has been described that the external power is supplied to the motor when the external power supply device turns on, the rope direction sensor senses a landing state and the tension applied to the rope tension sensor is greater than the reference value. However, since a great load is not applied to the motor during an operation of landing a container, the above work may be performed just with the power from the internal battery. This may be changed depending on the capacity of a battery used as an internal power source and may also be modified as desired.

As shown in Tables 1 and 2, in the present disclosure, power is supplied to the motor from both the external power supply device and the internal battery only when a great output is required at the motor serving as a load, but in other cases, namely when the crane performs an operation requiring a relatively smaller output to the motor, power is supplied to the motor just from the internal battery, and simultaneously the external power supply device charges the internal battery.

As described above, since the tired gantry crane according to the present disclosure adopts the contactless power transmission method using electromagnetic induction, it is possible to provide a tired gantry crane which does not deteriorate the degree of mobility freedom of the tired gantry crane, requires low maintenance costs in comparison to an existing hybrid-type gantry crane, and also needs low early-stage installation costs by using a relatively smaller-capacity battery.

In addition, since the tired gantry crane according to the present disclosure is designed to use only the internal battery when moving and receive deficient power from the external power supply device only when performing a work requiring a relatively great load, it is possible to prevent power from being unnecessarily wasted.

Figure 7:
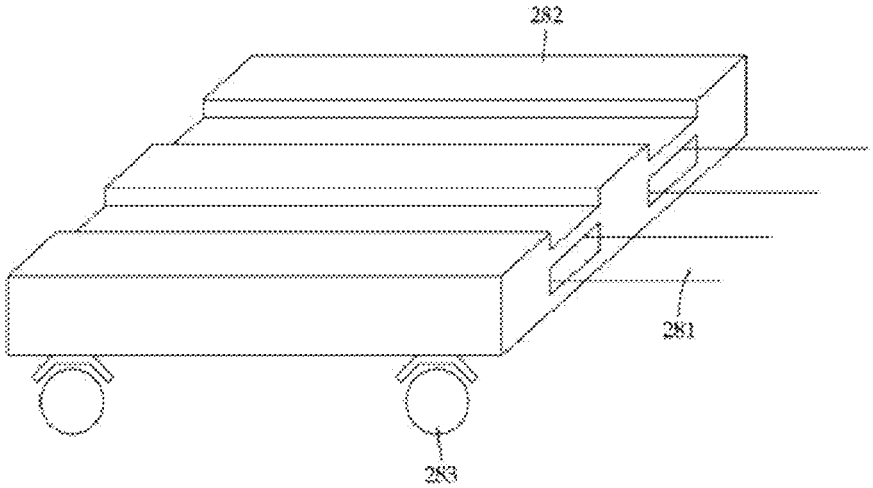
FIG. 7 is a diagram schematically showing an appearance of a power supply unit according to another embodiment of the present disclosure.

FIG. 7 is a diagram schematically showing an appearance of a power supply unit according to another embodiment of the present disclosure. The tired gantry crane of this embodiment is substantially identical to that of the former embodiment, but the power supply unit of this embodiment is different from that of the former embodiment.

In this embodiment, as shown in FIG. 3, at least one power supply unit is provided at each workspace. However, regarding a power supply unit 282 of another embodiment, just a single power supply unit is provided in a horizontal or vertical direction of a workspace. As described above, in order to cover a broader workspace than the workspace of the former embodiment, as shown in FIG. 7, the power supply unit 282 includes a moving unit 283 to allow movement, and a power line is coupled to at least one side thereof by using a coupling unit or the like. The power line is configured to be accommodated by means of the cable reel.

In this connection, it is possible to cover a plurality of workspaces formed at the container terminal while using the relatively expensive power supply unit 282 as few as possible. Other configurations of the gantry crane and the power collecting unit are substantially identical to those of the former embodiment and thus not described in detail here.

Figure 9:
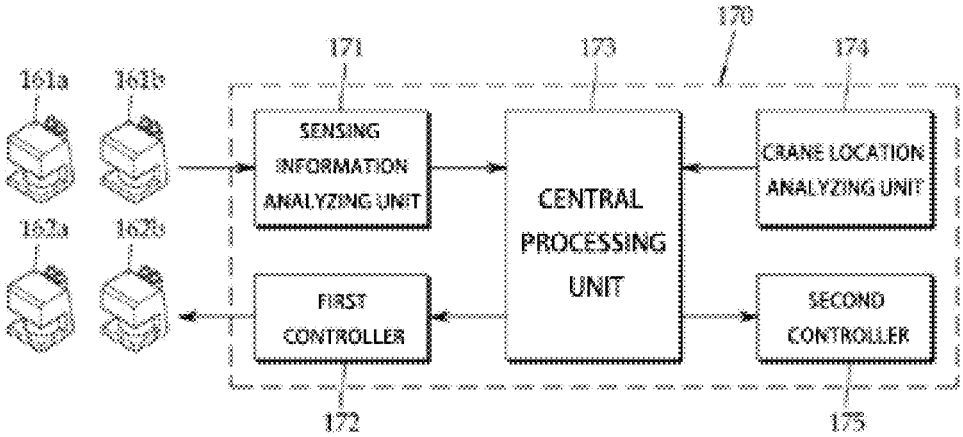
FIG. 9 is a block diagram for illustrating a main controller according to an embodiment of the present disclosure.

FIG. 9 is a schematic block diagram for illustrating the main controller 170 which controls operations of an automation system of the tired gantry crane according to an embodiment of the present disclosure.

Referring to FIG. 9, the main controller 170 includes a sensing information analyzing unit 171, a first controller 172, a central processing unit 173, a crane location analyzing unit 174 and a second controller 175.

The sensing information analyzing unit 171 analyzes sensing information provided from the first and second laser scanners 161*a*, 161*b*, 162*a*, 162*b*. The first and second laser scanners 161*a*, 161*b*, 162*a*, 162*b* sense a sensing area in real time and provides sensing information to the sensing information analyzing unit 171.

For example, the sensing information includes location information of an obstacle present in a crane running direction, location information of a container present in a container yard CA or a transport vehicle area TA, location information of a transport vehicle, location information of an external vehicle, and location information of a floating structure.

At this time, the location information may include a distance to an obstacle, size and shape of the obstacle, a distance to a container, size and shape of the container, a distance to an transport vehicle, size and shape of the transport vehicle, a distance to an external vehicle, size and shape of the external vehicle, a distance to a floating structure, and size and shape of the floating structure.

The central processing unit 173 allows the second controller 175 to adjust the running direction of the crane 100 according to the analysis result provided from the sensing information analyzing unit 171. At this time, the analysis result provided from the sensing information analyzing unit 171 includes whether an obstacle is present in the running direction of the crane, whether a container or a transport vehicle present in the container yard CA or the transport vehicle area TA, whether an external vehicle is present, and whether a floating structure is present. In addition, the analysis result includes a running direction setting value for stably moving the crane 100 according to a distance to an obstacle, size and shape of the obstacle, a distance to a container, size and shape of the container, a distance to an transport vehicle, size and shape of the transport vehicle, a distance to an external vehicle, size and shape of the external vehicle, a distance to a floating structure, and size and shape of the floating structure.

The second controller 175 is connected to a crane programmable logic control (PLC) (not shown). The crane PLC controls overall running operations of the crane 100 as a response to the command signal of the second controller 175. For example, the crane PLC may control a running direction of the crane when the crane is running or control a location of the crane when the crane stops. The main controller 170 may be connected to the crane PLC by means of RS232.

The crane location analyzing unit 174 analyzes a current location of the crane 100 and provides the current location to the central processing unit 173. Here, the location of the crane 100 includes a distance to a container or a transport vehicle, a distance to a floating structure, a preset crane running location, a target crane stop location or the like. In addition, various kinds of location information for determining a current location of the crane may be included. The location information of the crane 100 may be preset, measured in real time using separate equipment, or measured by GPS or the like and stored in a database.

The central processing unit 173 controls the first and second laser scanners 161*a*, 161*b*, 162*a*, 162*b* in real time through the first controller 172 according to the analysis result provided from the crane location analyzing unit 174. The first controller 172 may directly control the first and second laser scanners 161*a*, 161*b*, 162*a*, 162*b* or be connected to a local controller (not shown) to control the first and second laser scanners 161*a*, 161*b*, 162*a*, 162*b* via the local controller.

Figure 10:
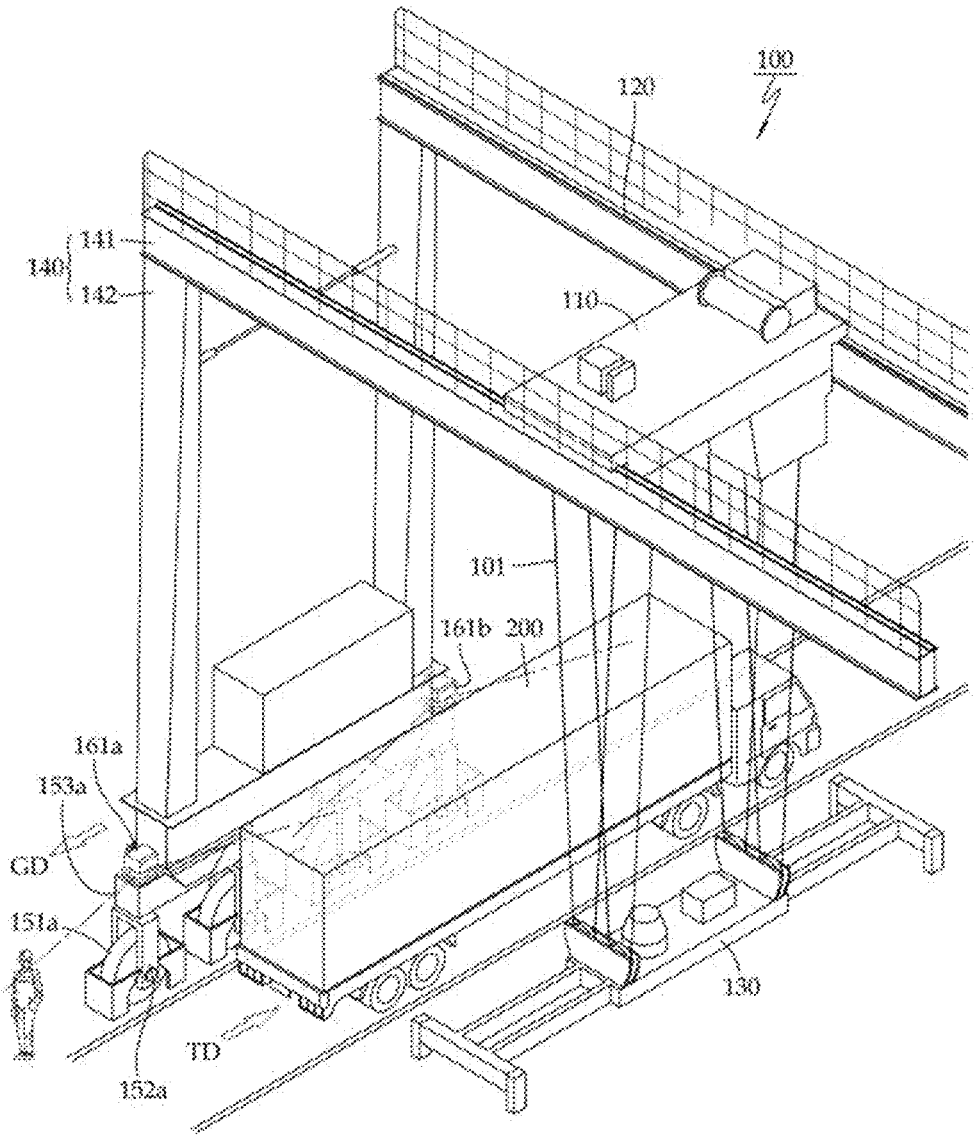
FIGS. 10 and 11 are diagrams for illustrating operation characteristics of a first laser scanner according to an embodiment of the present disclosure.
Figure 11:
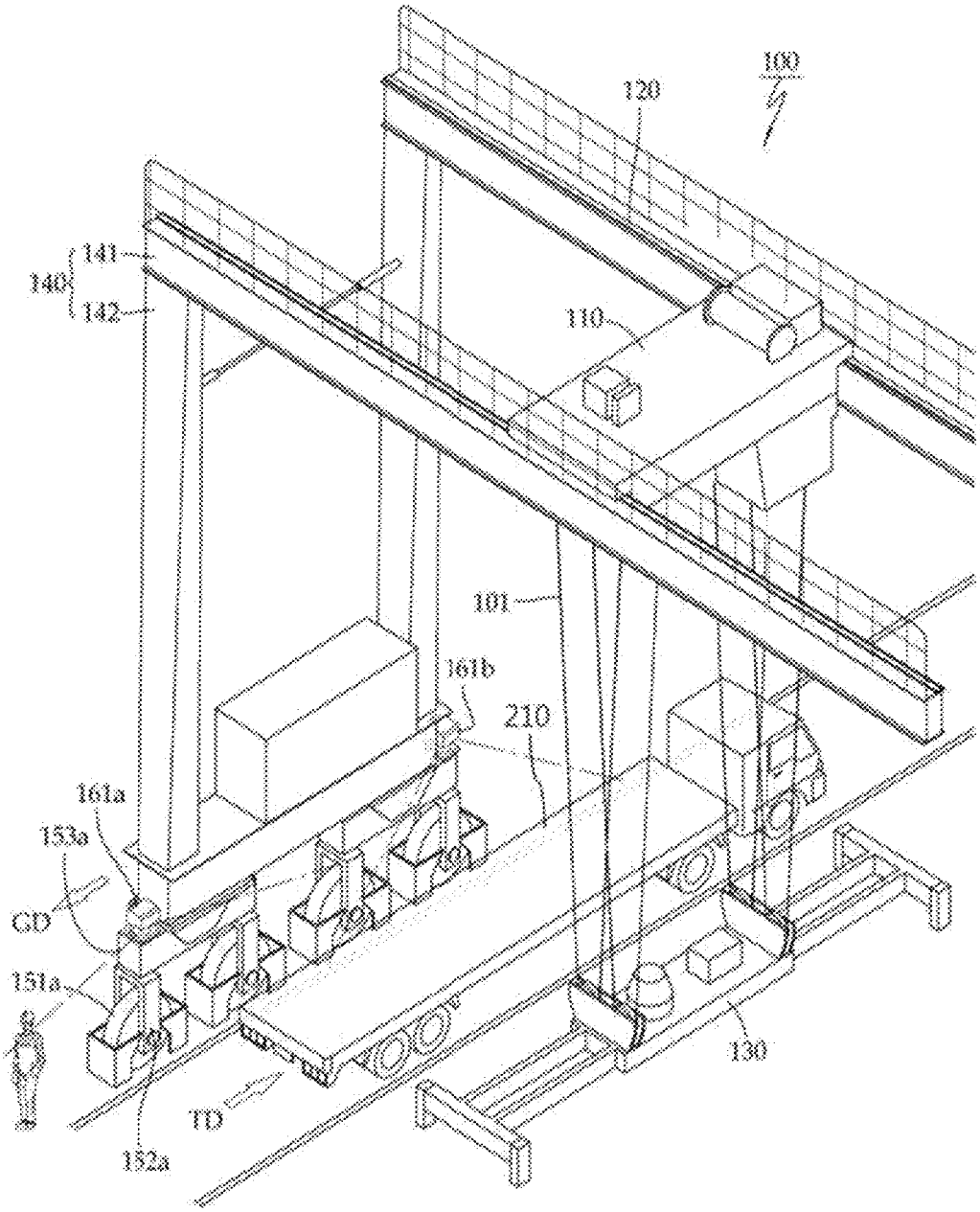

FIGS. 10 and 11 are perspective views for illustrating a crane running method and a container landing method using the first laser scanners 161*a*, 161*b* according to an embodiment of the present disclosure.

Figure 12:
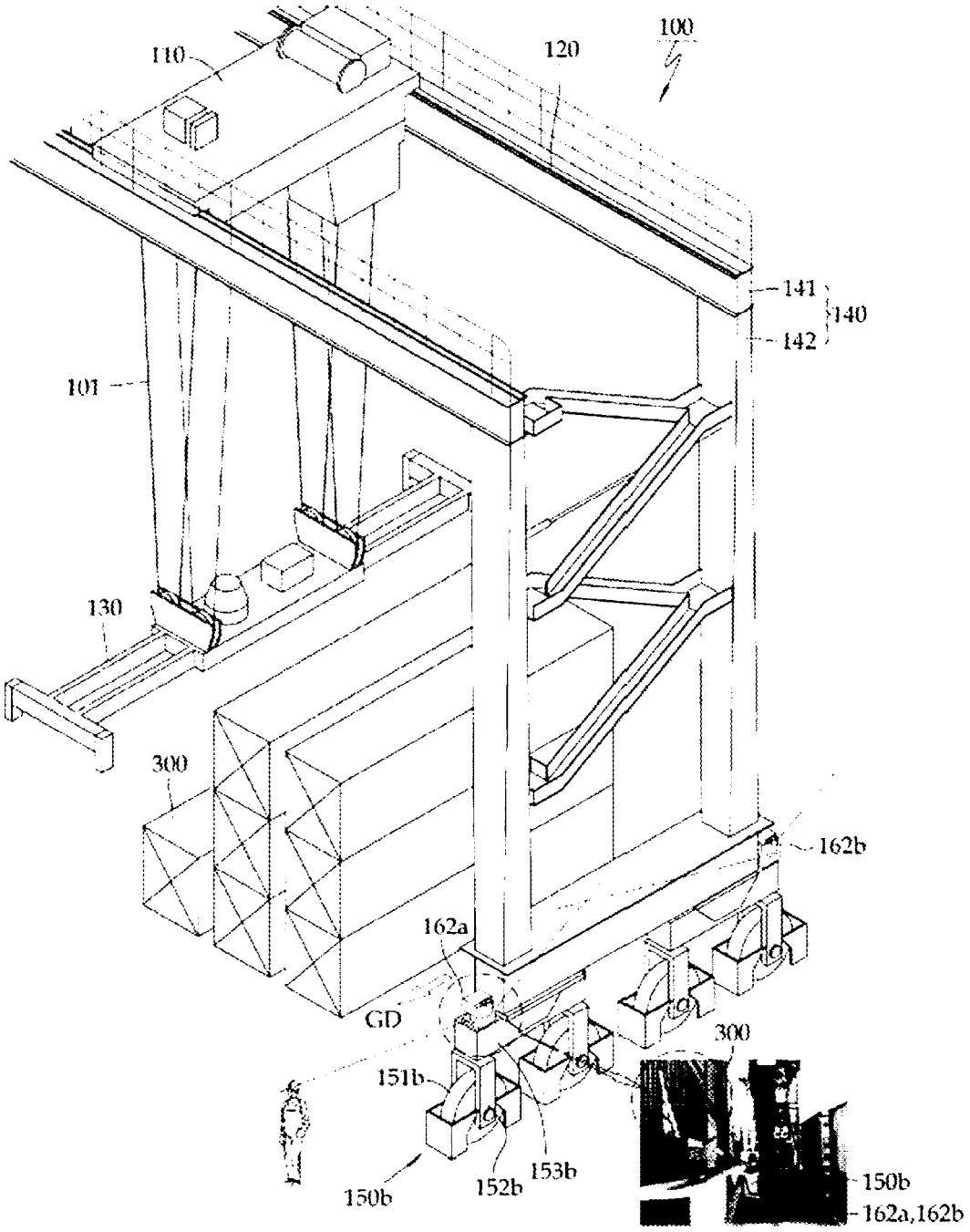
FIGS. 12 to 14 are diagrams for illustrating operation characteristics of a second laser scanner according to an embodiment of the present disclosure.
Figure 13:
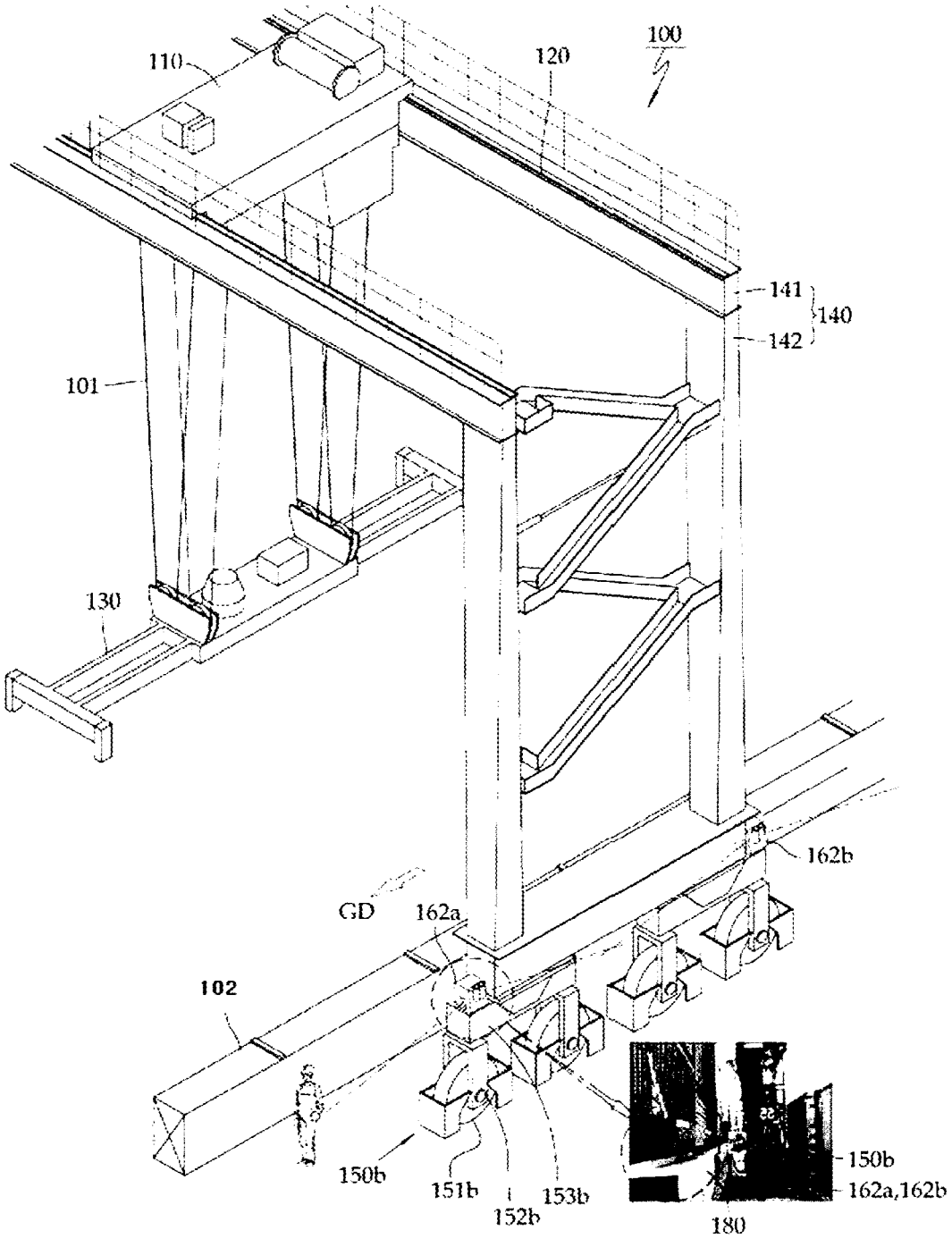
Figure 14:
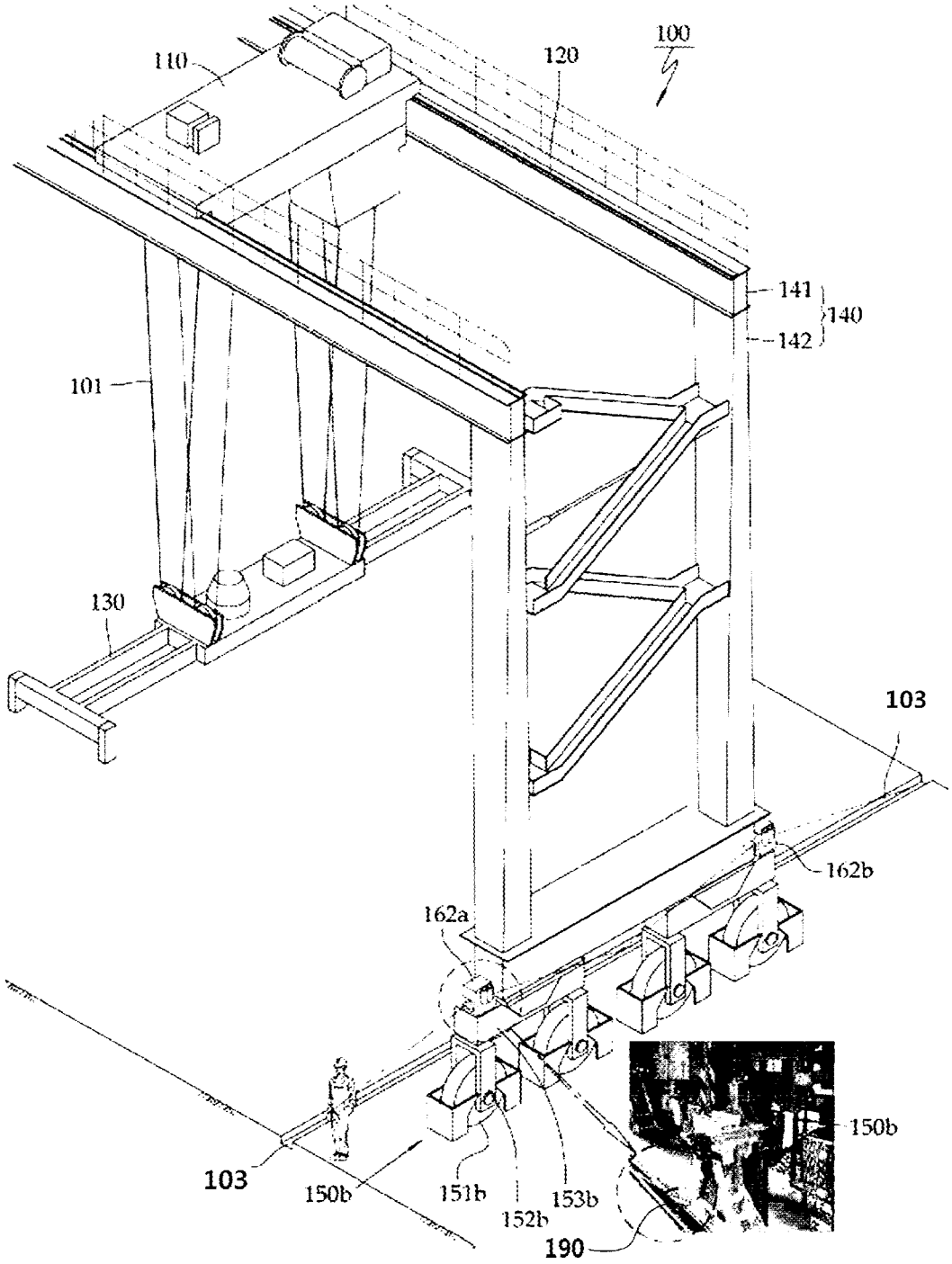

FIGS. 12 to 14 are perspective views for illustrating a crane running method and a container landing method using the second laser scanners 162*a*, 162*b* according to an embodiment of the present disclosure.

Referring to FIGS. 10 and 11, when the crane 100 is running, the first laser scanners 161*a*, 161*b* sense an obstacle present in a running direction of the crane 100, a transport vehicle 210 present in the transport vehicle area TA and, and a container 200 loaded on the transport vehicle 210 in real time.

Since the first laser scanners 161*a*, 161*b* may sense a region as much as 180 degrees or more, the first laser scanners 161*a*, 161*b* may sense an obstacle present in a running direction GD of the crane 100, a transport vehicle 210 present in the transport vehicle area TA and, and a container 200 loaded on the transport vehicle 210.

As described above, the first laser scanners 161*a*, 161*b* are controlled by the main controller 170 to rotate vertically based on the running direction of the crane 100 as a central axis.

For example, as shown in FIG. 10, if the container 200 is loaded on the transport vehicle 210, the first laser scanners 161*a*, 161*b* rotate upwards based on the central axis. Meanwhile, as shown in FIG. 11, if the container 210 is not loaded on the transport vehicle 210, the first laser scanners 161*a*, 161*b* rotate downwards based on the central axis.

When the crane is running, the main controller 170 checks whether an obstacle is present in the running direction by rotating the first laser scanners 161*a*, 161*b* vertically so that the running direction of the crane is viewed. In addition, the first laser scanners 161*a*, 161*b* are vertically adjusted to sense a location of the transport vehicle 210 or the container 200 in real time, and if the location of the transport vehicle 210 or the container 200 is sensed, the transport vehicle 210 is controlled to be located at the center of the crane 100 in order to facilitate easier landing works.

In other words, in order to stop the transport vehicle at a proper location, the main controller 170 analyzes a location of the transport vehicle 210 present in the transport vehicle area TA or the container 200 loaded on the transport vehicle 210 based on the sensing information obtained through the first laser scanners 161*a*, 161*b*, compares the location of the transport vehicle or the location of the container loaded on the transport vehicle with a current location of the crane 100, and provides a guide indication for adjusting the location to a driver of the transport vehicle according to the comparison result.

For example, the main controller 170 compares the location of the transport vehicle 210 with the location of the crane 100, and then if the current location of the transport vehicle 210 is not positioned at a proper location where the container is landed, the main controller 170 provides a guide indication to guide the transport vehicle 210 to a proper location through a guide indication device (not shown) installed near a visual field or the driver of the crane 100 or the transport vehicle. The driver of the transport vehicle moves the transport vehicle to the proper location where the container is landed, based on the guide indication provided through the guide indication device. At this time, the guide indication may be provided in various forms. For example, the guide indication may be provided as an arrow or a signal light.

Meanwhile, referring to FIGS. 12 to 14, when the crane 100 is running, the second laser scanners 162*a*, 162*b* senses an obstacle present in a running direction of the crane 100, a container 300 stored in the container yard CA and a floating structure therein in real time. For example, as shown in FIGS. 13 and 14, the floating structure may be a booth bar 102 or a cable reel hole 103.

As shown in FIG. 8, the second laser scanners 162*a*, 162*b* may sense as much as 180 degrees or more, similar to the first laser scanners 161*a*, 161*b*, and thus may sense an obstacle present in a running direction GD of the crane 100, a container 300 stored in the container yard CA, a booth bar 102 and a cable reel hole 103 in real time.

In addition, the second laser scanners 162*a*, 162*b* may rotate vertically based on the running direction of the crane 100 as a central axis, similar to the first laser scanners 161*a*, 161*b*.

For example, as shown in FIG. 12, if a container is stored in the container yard CA, the second laser scanners 162*a*, 162*b* rotate upwards from the central axis. Meanwhile, as shown in FIGS. 13 and 14, if a container is not stored in the container yard CA, the second laser scanners 162*a*, 162*b* rotate downwards from the central axis in order to sense a booth bar 102 or a cable reel hole 103 provided on the ground.

When the crane 100 is running, the main controller 170 checks whether an obstacle is present in the running direction by rotating the second laser scanners 162*a*, 162*b* vertically so that the crane is viewed in the running direction. In addition, the second laser scanners 162*a*, 162*b* are adjusted vertically to sense the container 300 or the floating structure stored in the container yard CA in real time, and if the location of the container 300 or the floating structure is sensed, the crane 100 is controlled so that the crane 100 may easily run and perform landing works. In other words, the main controller 170 recognizes a location of a floating structure and controls the crane 100 based on the recognized distance. By doing so, the crane 100 may automatically run.

Based on the sensed information provided through the first and second laser scanners 161*a*, 161*b*, 162*a*, 162*b* in real time, the sensing information analyzing unit 171 synthetically analyzes a location of the obstacle, a location of the transport vehicle, a location of the container loaded on the transport vehicle, whether a fixing device fixes the transport vehicle to the container, a location of the container stored in the container yard CA, a location of the floating structure and so on.

The central processing unit 173 compares the location information provided from the sensing information analyzing unit 171 with the current location information of the crane provided from the crane location analyzing unit 174, and controls a location of the crane through the second controller 175 according to the comparison result to facilitate easier running and landing.

For example, the central processing unit 173 determines whether the crane collides, based on the first and second sensing information provided from the first and second laser scanners 161*a*, 161*b*, 162*a*, 162*b*. In addition, based on the first sensing information provided from the first laser scanners 161*a*, 161*b*, the central processing unit 173 analyzes a location of the transport vehicle 210 present in the transport vehicle area TA and the container 200 loaded on the transport vehicle, compares the location of the transport vehicle or the container loaded on the transport vehicle with the current location of the crane, and provides the comparison result to control the transport vehicle 210 to a location for easier landing.

In addition, the central processing unit 173 analyzes a location of the container 300 and the floating structure stored in the container yard CA, based on the second sensing information provided from the second laser scanners 162*a*, 162*b*, compares the location of the container 300 or the floating structure with the current location of the crane, controls the crane 100 to a location for easier landing.

Figure 15:
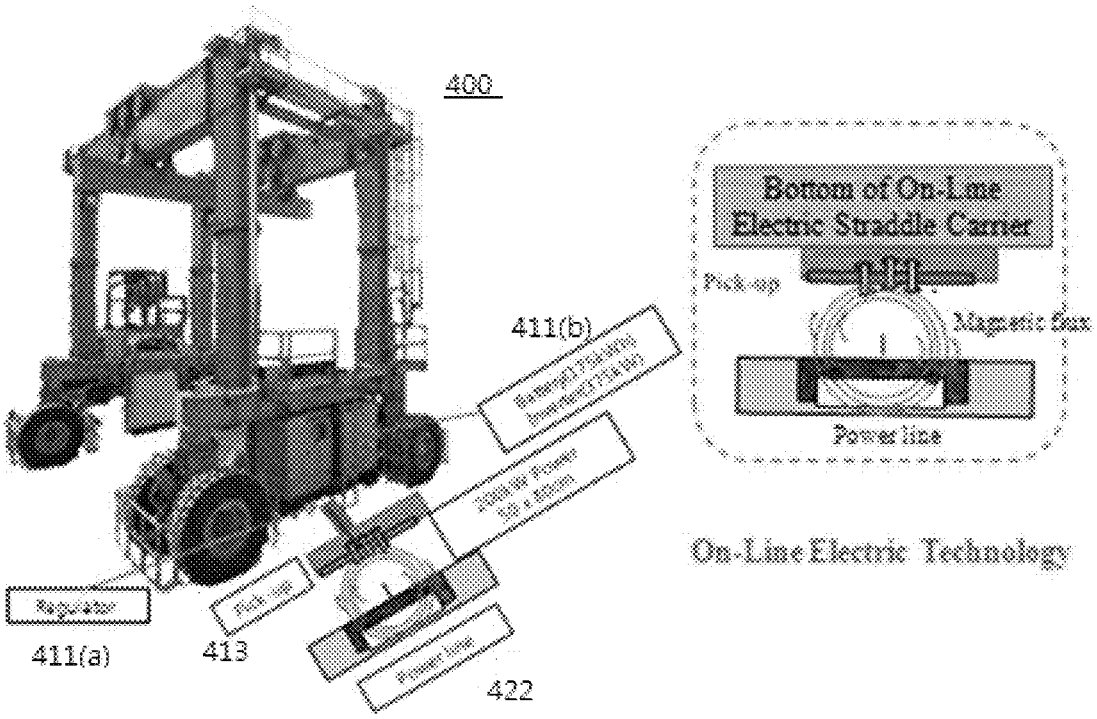
FIG. 15 is a diagram schematically showing an appearance of a straddle carrier for a harbor according to the present disclosure.

Meanwhile, FIG. 15 is a diagram showing a straddle carrier. In FIG. 15, a straddle carrier, designated by a reference symbol 400, according to the present disclosure uses a contactless power transmission method in order to solve problems of existing hybrid engines such as high maintenance costs and serious environmental pollution as well as problems of electric motors using batteries such as great installation costs of high-capacity batteries.

The present disclosure includes a power supply unit 420 installed at a workspace where the straddle carrier 400 runs and a power collecting unit 410 installed at the straddle carrier 400 in order to use the contactless power transmission method.

Figure 16:
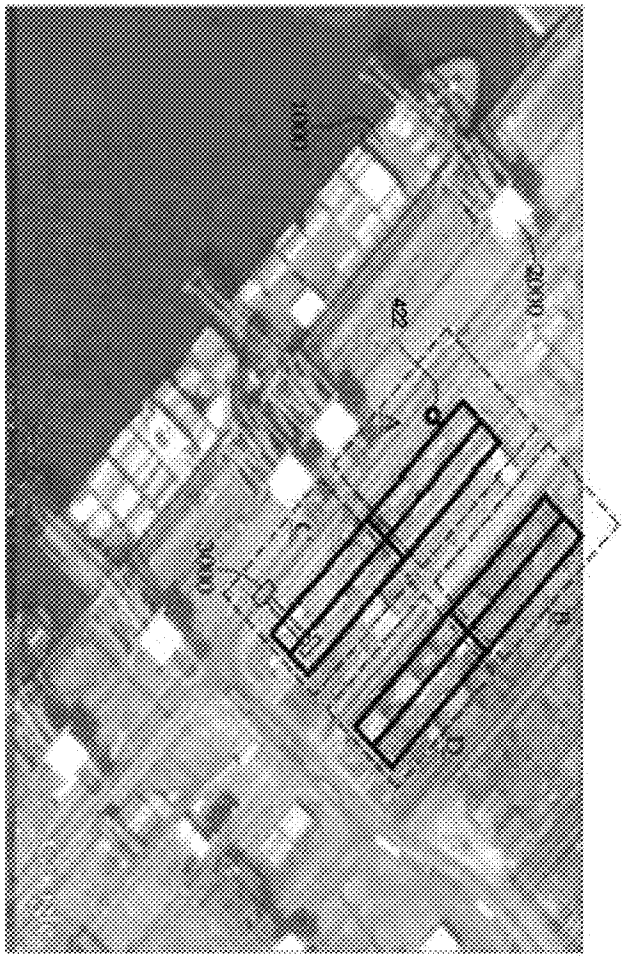
FIG. 16 is a diagram schematically showing an overall structure of a container terminal system formed at a harbor.

The power supply unit 420 is provided in advance in a workspace A to D as shown in FIG. 16. The power supply unit 420 has a general structure including a power supply line or power line 422, a power supply core and a power supply coil.

In addition, the power supply unit 420 employed in the present disclosure is preferably buried in the workspace A to D so as not to disturb movement of the straddle carrier but may also be exposed out. The power supply unit using magnetic induction is already known in the art and thus not described in detail here. Also, it is obvious to those skilled in the art that the power supply unit of the present disclosure may adopt any power supply unit known to the public prior to the filing of the present disclosure as an alternative.

Next, as shown in FIG. 15, the straddle carrier 400 according to the present disclosure includes a power collecting unit 410 provided at a bottom or a side frame of the straddle carrier, and the power collecting unit 410 includes a pick-up unit 413 and a power-collecting driving unit 411. Hereinafter, the configuration of the power collecting unit 410 will be described with reference to FIG. 18.

Figure 18:
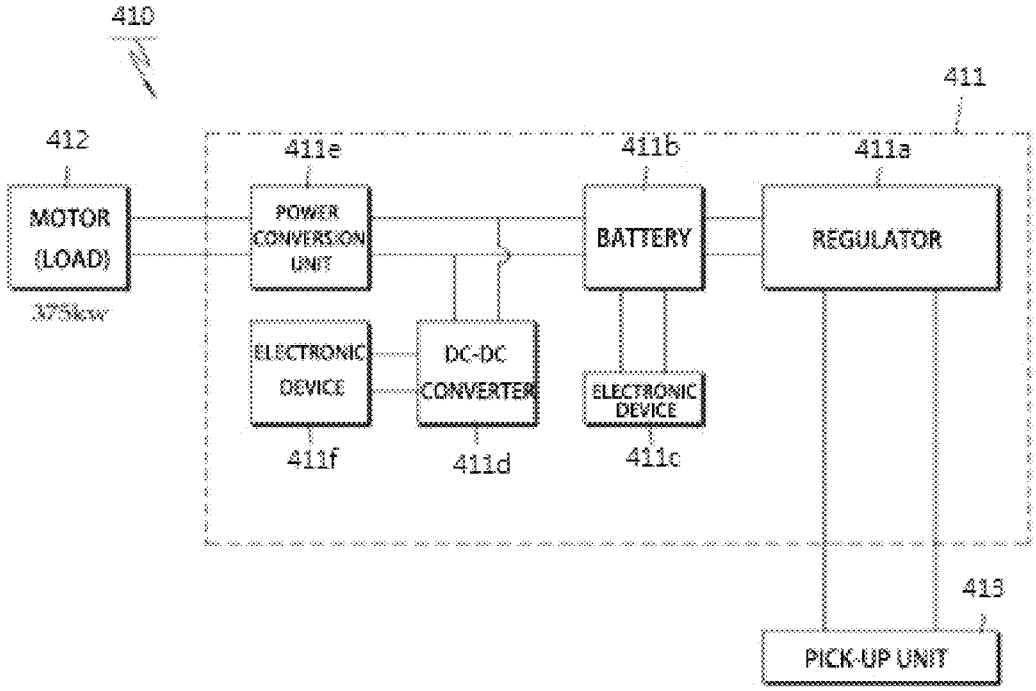
FIG. 18 is a diagram schematically showing a stabilizing circuit of a power collecting unit of the straddle carrier according to the present disclosure.

FIG. 18 is a circuitry block diagram schematically showing the power collecting unit 410 installed at the straddle carrier 400 according to the present disclosure. As shown in FIG. 18, the power collecting unit 410 includes a pick-up unit 413 for responding to a magnetic change from the power supply unit 420 and a power-collecting driving unit 411 for stably supplying the induced power obtained from the pick-up unit to a motor 412 serving as a load.

Figure 19:
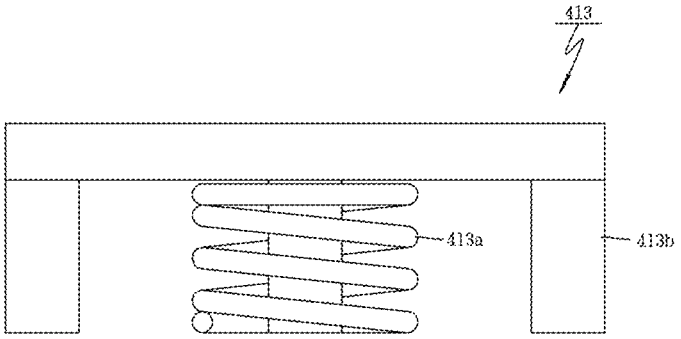
FIG. 19 is a diagram schematically showing a pick-up device of a power collecting unit according to the present disclosure.

FIG. 19 is a diagram showing the pick-up unit 413 of the power collecting unit 410, and the pick-up unit includes a power collecting coil 413*a* installed at a core 413*b*. The power supply unit 420 is configured to allow an induced current to flow by means of magnetic field induction if power is supplied from the power collecting coil 413*a*, as shown in FIG. 15.

In the present disclosure, the straddle carrier 400 is configured to receive power from the power supply unit 420 by means of magnetic induction when moving along the power line 422 of the power supply unit or stopping at the power line 422 of the power supply unit and charges the battery. For this, in an embodiment of the present disclosure, the pick-up unit 413 of the power collecting unit 410 is formed at a bottom or a side frame of the straddle carrier as shown in FIG. 15. Generally, power is supplied by means of magnetic induction through the pick-up unit 413 of the power collecting unit 410, if the distance between the pick-up unit 413 and the power supply unit 420 is small, the power supply efficiency is greatly improved. In order to adjust the distance between the pick-up unit and the power supply unit, in an embodiment of the present disclosure, the pick-up unit 413 may be connected by an elevation unit 430 so that it may be disposed horizontally adjacent to a magnetic field generating unit 421 of the power supply unit 420 provided on a road surface, if necessary.

In addition, one end of the pick-up unit 413 is connected to a frame of the straddle carrier 400 via an arm, and when power is supplied by means of magnetic induction with the power supply unit 420, the arm may be spread to be parallel to the power supply unit 420 formed on a road surface, and then when the straddle carrier 400 moves, the arm is formed to be perpendicular to the power supply unit 420.

Next, referring to FIG. 18, the induced power obtained from the pick-up unit 413 cannot be provided for a general power device (a motor driving power source), in the present disclosure, a power-collecting driving unit 413 or a stabilizing unit 413 is provided to stabilize the induced power obtained from the pick-up unit 413.

The induced power obtained from the pick-up unit 413 is firstly converted into DC power through a regulator 411*a* and the DC power is supplied to a load through a power conversion unit 411*e* for adjusting the DC power as an operating voltage of a motor 412 serving as a load.

At this time, if the motor is a three-phase alternate current motor, the power conversion unit 411*e* may employ an inverter for converting DC power to AC power again, and if the motor is an AC motor, a chopper or the like may be used for controlling DC power. In other words, the power conversion unit 411*e* may be modified depending on conditions of a load used.

In this embodiment, the motor 412 adopts a three-phase alternate current motor, and an inverter is used as the power conversion unit 411*e*.

In addition, as shown in FIG. 5, the stabilizing unit 411 of the power collecting unit 410 installed at the straddle carrier 400 according to the present disclosure further includes a lithium-ion battery 411*b* between the power conversion unit 411*e* and the regulator 411*a*. The lithium-ion battery 411*b* is configured to be rechargeable and supplies power required for the motor 412 together with the regulator 411*a*.

As described above, the charging capacity of the lithium-ion battery should be selected in consideration of efficiency and economic feasibility. In the present disclosure, the straddle carrier 400 moving in a certain working area of a container station may adopt a relatively smaller-capacity battery. Here, the straddle carrier 400 receives power from the power supply unit 420 and charges the battery 411*b* with the received power when moving along the power line 422 or stopping at the power line 422 for lifting or landing works of the straddle carrier 400. However, if the straddle carrier 400 moves beyond the power line 422 to a place such as a container open storage yard as shown in FIG. 4, the straddle carrier 400 receives power required for the motor from the charged battery.

In addition, the straddle carrier 400 according to the present disclosure maintains the lithium-ion battery 411*b* not to drop its voltage below a predetermined level and also includes a battery management system (BMS) circuit for preventing the lithium-ion battery 411*b* from being overcharged over a predetermined level, thereby stably maintaining the lithium-ion battery 411*b*.

In addition, when the straddle carrier 400 lifts a heavy container, the power received from the power collecting unit 410 and the power supplied from the battery are used together, but if a great power is not required, for example when a container is landed, the power received from the power collecting unit 410 is used for charging the battery.

In addition, the stabilizing unit 411 of the power collecting unit 410 installed at the straddle carrier 400 according to the present disclosure may further include a DC-DC converter 411*d* between the lithium-ion battery 411*b* and the power conversion unit 411*e* so that power may be stably supplied to an electronic device 411*f* required for the straddle carrier 400 in addition to the motor 412, for example a controller 480 required for controlling the straddle carrier.

As described above, the straddle carrier 400 according to the present disclosure may reduce maintenance costs in comparison to existing hybrid-type straddle carriers by adopting the contactless power transmission method using electromagnetic induction, and may also reduce early-stage installation costs by using a relatively smaller-capacity battery in comparison to an electrically-charging straddle carrier using an expensive large-capacity battery.

In addition, by adopting the contactless power transmission method using electromagnetic induction in the present disclosure, as shown in FIGS. 15 and 16, the power line 422 is installed in the workplaces A to D to transfer electric power to the power supply unit, and as power is supplied to the power line and thus electric current flows therein, an induced magnetic field is generated from the power line 422 as described above.

In order to use the power line 422 of the power supply unit 420 as a guideline for unmanned running of the straddle carrier 400, the straddle carrier 400 according to the present disclosure may further include an induced magnetic field sensing unit 450 for detecting an induced magnetic field generated from the power line.

The induced magnetic field sensing unit 450 is installed to be located at the front of the straddle carrier 400, similar to the pick-up unit 413 of the power collecting unit 410, and if electric current flows along the power line 422 formed in the workplace A to D to generate an induced magnetic field, the induced magnetic field sensing unit 450 senses the induced magnetic field and outputs a corresponding magnetic signal to the controller.

Figure 20:
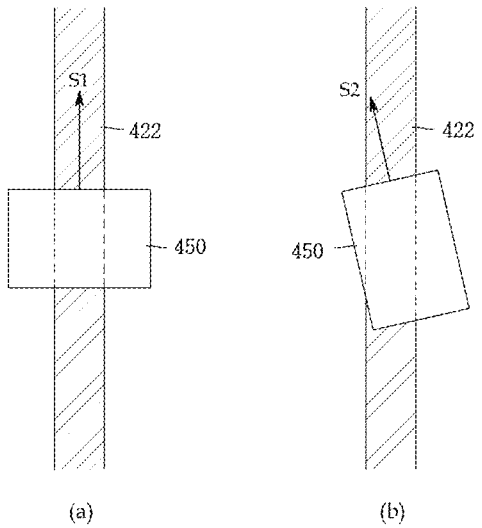
FIG. 20 is a schematic diagram for illustrating signal processing by matching an induced magnetic field detection unit with a power line according to an embodiment of the present disclosure.

FIG. 20 is a diagram showing a location relation between the power line 422 and the induced magnetic field sensing unit 450 according to the present disclosure. As shown in FIG. 20(*a*), if the induced magnetic field sensing unit 450 and the power line 422 are parallel to each other, a signal S1 is generated, and this signal is applied as a reference signal for determining a steering angle. In addition, as shown in FIG. 20(*b*), if the induced magnetic field sensing unit 450 and the power line 422 are not parallel to each other, a magnetic field density detected from the magnetic field generated from the power line is distorted, and thus a signal S2 different from the signal S1 is generated from the induced magnetic field sensing unit 450.

Therefore, the controller 480 directly or indirectly connected through a sensing information analyzing unit 490 disposed at a rear end of the induced magnetic field sensing unit 450 may detect a distortion of the straddle carrier from the power line by using a deviation between the signals S1 and S2 and may adjust a steering angle of the straddle carrier to be matched with the power line.

As described above, since the power supply line or power line for supplying power is used as a guideline for guiding a vehicle and the straddle carrier according to the present disclosure is controlled to move along the guideline by detecting an induced magnetic field by a magnetic reader or the like, the straddle carrier may stably run in an unmanned manner regardless of weathers such as heavy snow, different from an existing technique using a paint formed on a road surface.

In addition, the present disclosure may further include a laser scanner 440 at the front portion of the straddle carrier 400. The laser scanner 440 is configured to sense an obstacle present in the running direction of the straddle carrier 440. The laser scanner 440 is configured to be rotatable as much as 180 degrees in vertical and horizontal directions under the control of the controller 480.

Figure 17:
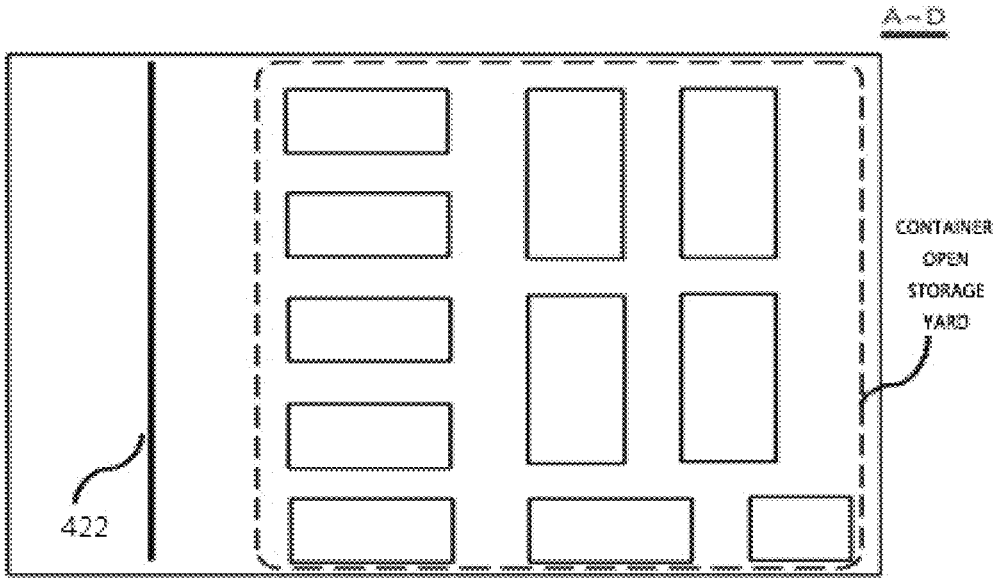
FIG. 17 is a diagram schematically showing a container open storage yard at a container terminal.
Figure 21:
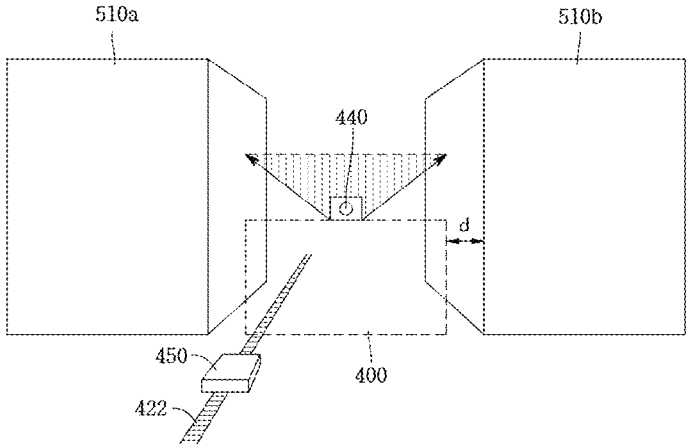
FIG. 21 is a diagram schematically showing an example where an obstacle is found at the front by using a laser scanner according to an embodiment of the present disclosure.

The straddle carrier 400 may run between containers 510*a*, 510*b* stacked, as shown in FIG. 17 or 21, due to its operating nature. In this case, a power line may be formed between containers, and the straddle carrier 400 may run by using the power line 422 as a guideline. However, when unmanned running is performed between containers by using the guideline, if the containers 510*a*, 510*b* exist within an error range of the unmanned running using the guideline, the straddle carrier 400 may collide with the containers 510*a*, 510*b*.

In other words, if the straddle carrier 400 runs by using only a guideline such as a power line in an environment free from an obstacle, the straddle carrier 400 may stably run relatively fast. However, if an obstacle is present as shown in FIG. 21, the straddle carrier 400 may collide with the obstacle. In the present disclosure, the laser scanner 440 is preferably provided further to solve this problem.

Figure 22:
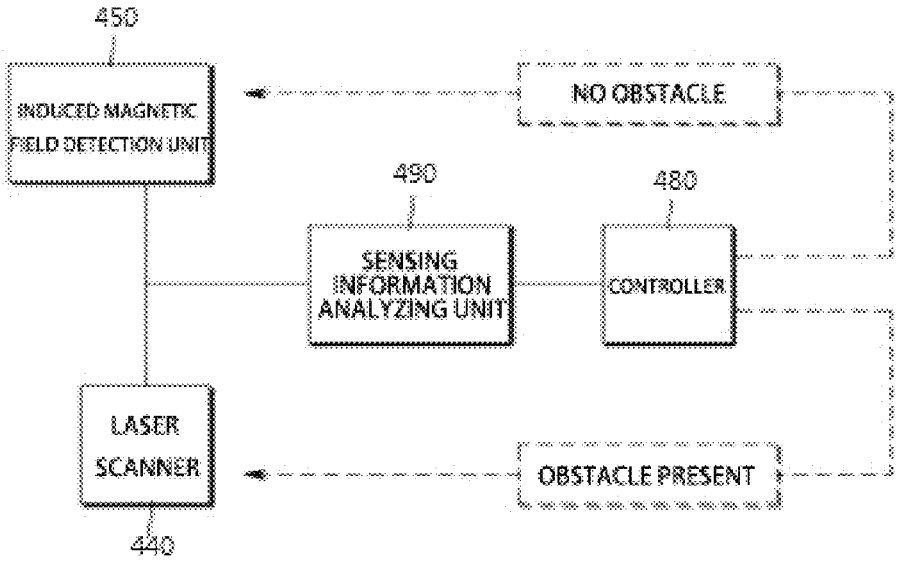
FIG. 22 is a schematic diagram for illustrating a running method of the straddle carrier using an induced magnetic field detection unit and a laser scanner.

Therefore, as shown in FIG. 22, if no obstacle is sensed in the running direction of the straddle carrier 400 by the laser scanner 440, unmanned running is controlled to use the power line as a guideline. However, if it is determined that an obstacle is present in the running direction of the straddle carrier 400 through the laser scanner 440 or there is no guideline, the laser scanner is preferably used to perform the unmanned running.

Referring to FIG. 21 again, an example of the unmanned running using the laser scanner 440 is depicted. Here, if the straddle carrier 400 runs between containers 510*a*, 510*b*, an obstacle at the front of the laser scanner 440 is sensed in real time, and the sensed signal is transmitted to the sensing information analyzing unit 490 located at the rear. Also, the sensing information analyzing unit 490 analyzes a size of an obstacle, a distance to the straddle carrier, a shape of the container, a shape of the obstacle, a distance to the obstacle and location information, and transmit data required for running, for example a current distance (d) between the container and the straddle carrier, to the controller. The controller may generate stable running information based on the data received from the sensing information analyzing unit.

In this embodiment, it has been illustrated that an obstacle is sensed using a laser scanner. However, the present disclosure is not limited thereto, and it is obvious to those skilled in the art that the present disclosure may be modified so that an obstacle is sensed using another device such as a camera.

As described above, the straddle carrier according to the present disclosure may reduce maintenance costs in comparison to existing hybrid-type straddle carriers by adopting the contactless power transmission method using electromagnetic induction, and may also reduce early-stage installation costs by using a relatively smaller-capacity battery in comparison to an electrically-charging straddle carrier using an expensive large-capacity battery.

In addition, since the power supply line or power line for supplying power is used as a guideline for guiding a vehicle and the straddle carrier according to the present disclosure is controlled to move along the guideline by a magnetic reader or the like, the straddle carrier may stably run in an unmanned manner regardless of weather changes, different from an existing technique using a paint formed on a road surface.

In the present disclosure, in order to control unmanned running more precisely, the straddle carrier according to the present disclosure may further include a GPS receiving device capable of recognizing may information of a workspace and a current location of the straddle carrier, and may also further include an RPM sensing device of a tachometer or the like capable of checking a moving distance more accurately by counting RPM of wheels of the straddle carrier. In addition, if the tachometer or the like is included, a reset mark for resetting the tachometer at certain distance intervals may be formed on a road surface or the like to reduce a moving distance recognition error caused by sliding of wheels, and the power supply unit may also be configured to reset the tachometer to support unmanned running precisely.

The above description is just an example to show the technical features of the present disclosure, and it is obvious to those skilled in the art that various changes and modifications can be made without departing from the essence of the present disclosure. Therefore, embodiments of the present disclosure are not intended to limit the scope of the present disclosure but for better understanding, and the scope of the present disclosure is not limited by the embodiments.

Therefore, the scope of the present disclosure should be defined by the appended claims, and all technical features belonging thereto or equivalent thereto should be interpreted as falling within the scope of the present disclosure.

What is claimed is:

1. A tired gantry crane for receiving power in a contactless fashion, comprising:

a rechargeable battery provided to supply power from the inside thereof; and a power collecting unit configured to receive power from a power supply unit installed at the outside, wherein the power supply unit and the power collecting unit interact with each other by means of magnetic induction;

the tired gantry crane further comprises a power controller for managing supply of power; and the power controller controls supply of power through the rechargeable battery formed therein and the power supply unit depending on an operation state of the tired gantry crane.

2. The tired gantry crane for receiving power in a contactless fashion according to claim 1, wherein the power collecting unit includes a pick-up unit, and the pick-up unit includes a power collecting core and a power collecting coil, and wherein one end of the pick-up unit is connected to a frame of the tired gantry crane via an arm, and when power is supplied by means of magnetic induction with the power supply unit, the arm is spread to be parallel to the power supply unit formed on a road surface, and then when the tired gantry crane moves, the arm is folded to be perpendicular to the power supply unit.

3. The tired gantry crane for receiving power in a contactless fashion according to claim 1, wherein when the tired gantry crane is moving, the power controller controls to supply power from the rechargeable battery to a motor, which operates as a load.

4. The tired gantry crane for receiving power in a contactless fashion according to claim 1, wherein the tired gantry crane further comprises a unit for detecting a moving direction and a tension of a rope to which a container is suspended, and wherein the power controller controls to supply power from the power supply unit to a load based on the moving direction and the tension of the rope.

5. The tired gantry crane for receiving power in a contactless fashion according to claim 4, wherein when the moving direction of the rope is a lifting direction, the power controller supplies power from both the rechargeable battery and the power supply unit to a motor which operates as a load, and wherein when the moving direction of the rope is a landing direction, the power controller supplies power from the rechargeable battery to the motor which operates as a load, and the power from the power supply unit is used for charging the rechargeable battery.

6. The tired gantry crane for receiving power in a contactless fashion according to claim 1, wherein the power supply unit is buried or exposed to be parallel to a road surface.

7. The tired gantry crane for receiving power in a contactless fashion according to claim 1, further comprising:

first laser scanners respectively installed at front and rear portions of a left wheel of the tired gantry crane one by one to sense an obstacle present in a running direction of the tired gantry crane, a transport vehicle present in a transport vehicle area and a container loaded on the transport vehicle by means of vertical rotation and provide corresponding first sensing information;

second laser scanners respectively installed at front and rear portions of a right wheel of the tired crane one by one to sense a container stored in a container yard and a floating structure installed in the running direction of the tired gantry crane by means of vertical rotation and provide corresponding second sensing information; and a main controller for receiving the first and second sensing information, controlling a collision of the tired gantry crane based on the first or second sensing information, and rotating the first laser scanner to control the first laser scanner to sense the transport vehicle when a container is not loaded on the transport vehicle present in the transport vehicle area based on the first sensing information.

8. The tired gantry crane for receiving power in a contactless fashion according to claim 7, wherein the first and second laser scanner is a two-dimensional laser scanner or a three-dimensional laser scanner.

9. The tired gantry crane for receiving power in a contactless fashion according to claim 7, wherein the first laser scanners sense a fixing device for fixing a container loaded on the transport vehicle to the transport vehicle and provide information about whether the container loaded on the transport vehicle is separated from the transport vehicle when the container is unloaded from the transport vehicle.

10. The tired gantry crane for receiving power in a contactless fashion according to claim 7, wherein the main controller analyzes a location of the transport vehicle present in the transport vehicle area or the container loaded on the transport vehicle based on the first sensing information, compares the location of the transport vehicle or the location of the container loaded on the transport vehicle with a current location of the tired gantry crane, and provides a guide indication for location adjustment to a driver of the transport vehicle according to the comparison result.

11. The tired gantry crane for receiving power in a contactless fashion according to claim 7, wherein the main controller analyzes a location of an obstacle present in a running direction of the tired gantry crane based on the first sensing information, compares the location of the obstacle with a current location of the tired gantry crane, and controls the location of the tired gantry crane not to collide with the obstacle.

12. The tired gantry crane for receiving power in a contactless fashion according to claim 1, first laser scanners respectively installed at front and rear portions of a left wheel of the tired gantry crane one by one to sense an obstacle present in a running direction of the tired gantry crane, a transport vehicle present in a transport vehicle area and a container loaded on the transport vehicle by means of vertical rotation and provide corresponding first sensing information;

second laser scanners respectively installed at front and rear portions of a right wheel of the tired gantry crane one by one to sense a container stored in a container yard and a floating structure installed in the running direction of the tired gantry crane by means of vertical rotation and provide corresponding second sensing information; and a main controller for receiving the first and second sensing information, controlling a collision of the tired gantry crane based on the first or second sensing information, and rotating the second laser scanner to control the second laser scanner to sense the floating structure when a container is not loaded present in the container yard based on the first sensing information.

13. The tired gantry crane for receiving power in a contactless fashion according to claim 12, wherein the main controller analyzes a location of the container stored in the container yard or a location of the floating structure based on the second sensing information, compares the location of the container stored in the container yard or the location of the floating structure with a current location of the tired gantry crane, and controls a location of the tired gantry crane.

14. The tired gantry crane for receiving power in a contactless fashion according to claim 12, wherein the main controller analyzes a location of an obstacle present in a running direction of the tired gantry crane based on the second sensing information, compares the location of the obstacle with a current location of the tired gantry crane, and controls the tired gantry crane not to collide with the obstacle.

15. The tired gantry crane for receiving power in a contactless fashion according to claim 12, wherein the floating structure is a booth bar or a cable reel hole.

16. The tired gantry crane for receiving power in a contactless fashion according to claim 12, wherein the main controller recognizes a location of the floating structure and controls the tired gantry crane based on the recognized distance.

17. A straddle carrier for receiving power in a contactless fashion, comprising:

a power collecting unit configured to receive power in a contactless fashion from a power supply unit installed at the outside, wherein the power collecting unit charges a rechargeable battery installed at the straddle carrier, wherein the power supply unit and the power collecting unit interact with each other by means of magnetic induction;

the power collecting unit receives power from the power supply unit and charges the rechargeable battery with the power when the straddle carrier is moving along a power line or stop; and the rechargeable battery supplies power to a load when the straddle carrier moves beyond the power line.

18. The straddle carrier for receiving power in a contactless fashion according to claim 17, wherein the power collecting unit includes a pick-up unit, and the pick-up unit includes a power collecting core and a power collecting coil, and wherein one end of the pick-up unit is connected to a bottom frame of the straddle carrier via an elevation unit, and when power is supplied by means of magnetic induction between the power supply unit and power collecting unit, the pick-up unit is disposed adjacently to be parallel to the power supply unit formed on a road surface by means of the elevation unit.

* * * * *